US006594451B2

(12) United States Patent
Kakeshita et al.

(10) Patent No.: US 6,594,451 B2
(45) Date of Patent: Jul. 15, 2003

(54) IMAGE FORMING APPARATUS, AND USE SITUATION REPORTING SYSTEM FOR REPORTING USE SITUATIONS OF DEVELOPER AND OTHER CONSUMABLES STOWED IN IMAGE FORMING APPARATUS

(75) Inventors: Tomomi Kakeshita; Hiroshi Sasame; Hiroaki Ogata; Shinya Yamamoto, all of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/731,712

(22) Filed: Dec. 8, 2000

(65) Prior Publication Data

US 2001/0004423 A1 Jun. 21, 2001

(30) Foreign Application Priority Data

Dec. 15, 1999 (JP) ..... 11-356727

(51) Int. Cl.[7] ..... G03G 15/00

(52) U.S. Cl. ..... 399/24; 399/25; 399/26; 399/27; 399/31; 399/81

(58) Field of Search ..... 399/24–27, 29, 399/31, 81

(56) References Cited

U.S. PATENT DOCUMENTS 4,851,875 A * 7/1989 Tanimoto ..... 399/24
5,475,471 A 12/1995 Kisu et al.
5,534,344 A 7/1996 Kisu et al. ..... 428/323
5,546,167 A 8/1996 Ogata et al.
5,548,374 A * 8/1996 Iguchi et al. ..... 399/24
5,678,141 A 10/1997 Asano et al. ..... 399/115
5,802,420 A * 9/1998 Garr et al. ..... 399/27
5,835,818 A 11/1998 Hoshika et al. ..... 399/26
5,877,692 A * 3/1999 Watanabe et al. ..... 399/25 X
6,253,036 B1 * 6/2001 Karakama et al. ..... 399/27
6,275,664 B1 * 8/2001 Wolf et al. ..... 399/27 X
6,295,423 B1 * 9/2001 Haines et al. ..... 399/24

FOREIGN PATENT DOCUMENTS

JP 10-274908 10/1998

* cited by examiner

*Primary Examiner*—William J. Royer
(74) *Attorney, Agent, or Firm*—Fitzpatrick, Cella, Harper & Scinto

(57) ABSTRACT

A use situation reporting system reports the use situations of a developer and other consumables included in an image forming apparatus for forming images on a recording material. More particularly, the use situation reporting system reports an amount of remaining developer and the use times of consumables to a user. Thus, the timing of replacing a cartridge with a new one can be concisely reported to the user.

22 Claims, 16 Drawing Sheets

IMAGE FORMING APPARATUS, AND USE SITUATION REPORTING SYSTEM FOR REPORTING USE SITUATIONS OF DEVELOPER AND OTHER CONSUMABLES STOWED IN IMAGE FORMING APPARATUS

BACKGROUND OF THE INVENTION

1. Field of the Invention

The present invention relates to an image forming apparatus of, for example, an electrophotographic type, and a use-situation reporting system for reporting the use situations of a developer and the other consumables stowed in the image forming apparatus. More particularly, the present invention contributes to improvement of a service to be provided for a user of such an image forming apparatus having a cartridge detachably attached thereto.

Herein, the electrophotographic image forming apparatuses adopting electrophotography include, for example, an electrophotographic copier, electrophotographic printers (for example, an LED printer and a laser beam printer), and an electrophotographic facsimile system.

The cartridge detachably attached to a main unit of an electrophotographic image forming apparatus accommodates at least one of an electrophotographic photosensitive body, charging means for charging the electrophotographic photosensitive body, a developing means for supplying a developer to the electrophotographic photosensitive body, and a cleaning means for cleaning the electrophotographic photosensitive body. In particular, what is referred to as a process cartridge is a cartridge into which at least one of the charging means, developing means, and cleaning means, and the electrophotographic photosensitive body are integrated. The cartridge is detachably attached to the main unit of the electrophotographic image forming apparatus. Alternatively, the developing means and electrophotographic photosensitive body are integrated into a cartridge, and the cartridge is detachably attached to the main unit of the electrophotographic image forming apparatus.

2. Description of the Related Art Conventionally

Conventionally, electrophotographic image forming apparatuses including an electrophotographic copier and a laser beam printer project light, which represents image information, to an electrophotographic photosensitive body (photosensitive body) to form a latent image. A developing means is then used to supply a developer to the latent image, whereby the latent image becomes a visible image. The image is then transferred from the photosensitive body to a recording material, and thus formed on the recording material. A developer storage is coupled to the developing means. As more and more images are formed, the developer is consumed.

For the image forming apparatus, a process cartridge system may be adopted in order to facilitate convenience in replacing the consumables including the electrophotographic photosensitive body and developer with new ones and maintaining them. According to the process cartridge system, the electrophotographic photosensitive body, the developing means, charging means, and a cleaning means as well as a developer container and a waste developer container are integrated into a cartridge that is referred to as a process cartridge. The developing means, charging means, and cleaning means serve as processing means for working on the electrophotographic photosensitive body. The process cartridge is detachably attached to the main unit of the image forming apparatus. According to the process cartridge system, a user can maintain the apparatus without the necessity of asking a serviceperson. This leads to drastically improved operability. The process-cartridge system is widely adopted for electrophotographic image forming apparatuses.

In a process cartridge type image forming apparatus, when the service life of a process cartridge has completed its life span, for example, when a developer has run out, the user merely replaces the process cartridge with a new one. Thus, the image forming apparatus can form images again.

Several factors that determine the service life of the process cartridge include the amount of developer, the fatigue of a photosensitive body, the fatigue of charging means, and the fatigue of a developer bearing member. The most significant factor is the amount of developer.

For managing the service life of the process cartridge, a remaining developer sensing means included in the cartridge or the main unit of the image forming apparatus is used to sense the amount of remaining developer. A signal that represents the amount of remaining developer is then sent to the image forming apparatus itself or a display device of a host computer or a terminal personal computer (PC) connected to the image forming apparatus. Thus, the amount of remaining developer is reported to the user.

The remaining developer sensing means for sensing an amount of remaining developer may be realized with various types of sensors. For example, the remaining developer sensing means may be realized with a piezoelectric sensor for sensing the presence or absence of a developer by checking if it is in contact with the developer, or a magnetic sensor suitable for a magnetic developer. Otherwise, if an alternating bias is applied to the developer bearing member that supplies the developer to the photosensitive body, an antenna sensor will do.

A dot counting method is a method of sensing the amount of developer without the necessity of including the foregoing remaining developer sensing means in a development unit. According to the dot counting method, pixel pulses used to form dots are counted. An amount of consumed developer is calculated on the assumption that the count value is proportional to the amount of consumed developer.

However, even if the remaining developer sensing means is used to sense the amount of remaining developer to manage the service life of the process cartridge, it is impossible to see if the service life of the process cartridge has completed its span. Poor-quality images may be produced before the developer runs out.

For example, assume that an image forming apparatus is used to produce at every time a small number of printouts of a low print ratio (image ratio), that is, printouts whose ratio of the printed portion to the whole is low (hereinafter, this usage shall be referred to as a low print-ratio mode). In this case, before the developer runs out, the service lives of any other consumable such as the photosensitive body, a developing roller that is the developer bearing member, or a charging roller that is the charging means may have completed their life spans.

The process cartridge accommodates consumables other than the developer. A user could not have learned the use times of the consumables in the past.

For example, although an indication of an amount of remaining developer does not signify that the service life of any consumable has completed its life span, a poor-quality image may be output. In this case, a user cannot find out the cause and may therefore complain to a manufacturer. The user may then return the process cartridge to the manufacturer.

In contrast, if the use times of consumables other than the developer are reported to a user, the user becomes aware that the service life of the process cartridge has completed its life span. That is to say, even when an indication of an amount of remaining developer used to directly manage the service life of the process cartridge does not signify that the service life of the process cartridge has completed its life span, the use times of the other consumables may have exceeded predetermined service lives. In this case, the service life of the process cartridge has substantially completed its life span. For example, assume that a serviceperson uses a communicating means such as a telephone to ask a user about the amount of remaining developer and the use times of the other consumables. The serviceperson can thus grasp the state of the process cartridge and can distinctly explain to the user about the current situation of the process cartridge.

SUMMARY OF THE INVENTION

The present invention attempts to solve the foregoing problems. An object of the present invention is to provide a use-situation reporting system for reporting the amount of remaining developer and the amount of use of the other consumables, and an image forming apparatus, wherein the timing of replacing a cartridge with a new one is reported in an easy-to-understand manner.

Another object of the present invention is to provide a use situation reporting system for reporting an amount of remaining developer and the amount of use of the other consumables, and an image forming apparatus, wherein the number of returned goods attributable to users' complaints is decreased. Moreover, users or servicepersons working for a manufacturer can grasp the contents of complaints over a communication network, and the servicepersons' labor of visiting the users are obviated.

Still another object of the present invention is to provide a use-situation reporting system for reporting the amount of remaining developer and the amount of use of the other consumables, and an image forming apparatus, wherein the amount of remaining developer and the amount of use of the other consumables are reported to a user. Moreover, the user can concisely learn the timing of replacing a cartridge with a new one.

Still another object of the present invention is to provide a use-situation reporting system for reporting the amount of remaining developer and the amount of use of the other consumables comprising an amount-of-developer detecting means, a sensing means, and a display means. The amount-of-developer detecting means detects the amount of developer remaining in a developer container. The sensing means senses the amount of use of the consumables. The display means indicates the amount of developer sensed by the amount-of-developer detecting means and the amount of use of the consumables sensed by the sensing means.

Still another object of the present invention is to provide an image forming apparatus comprising a container, a remaining developer sensing means, consumables other than a developer, an amount-of-use sensing means, and an output means. The developer is stowed in the container. The remaining developer sensing means senses the amount of developer remaining in the container. The consumables are used to form developer images on a recording material. The amount-of-use sensing means senses the amount of use of the consumables. The output means outputs mutually independently information of the amount of remaining developer sensed by the remaining developer sensing means and information of the amount of use sensed by the amount-of-use sensing means.

Further objects, features and advantages of the present invention will become apparent from the following description of the preferred embodiments with reference to the attached drawings.

DESCRIPTION OF THE PREFERRED EMBODIMENTS

A use-situation reporting system for reporting the amount of remaining developer and the use times of the other consumables and an image forming apparatus in accordance with the present invention will be described in conjunction with the drawings below.

First Embodiment

Figure 1:
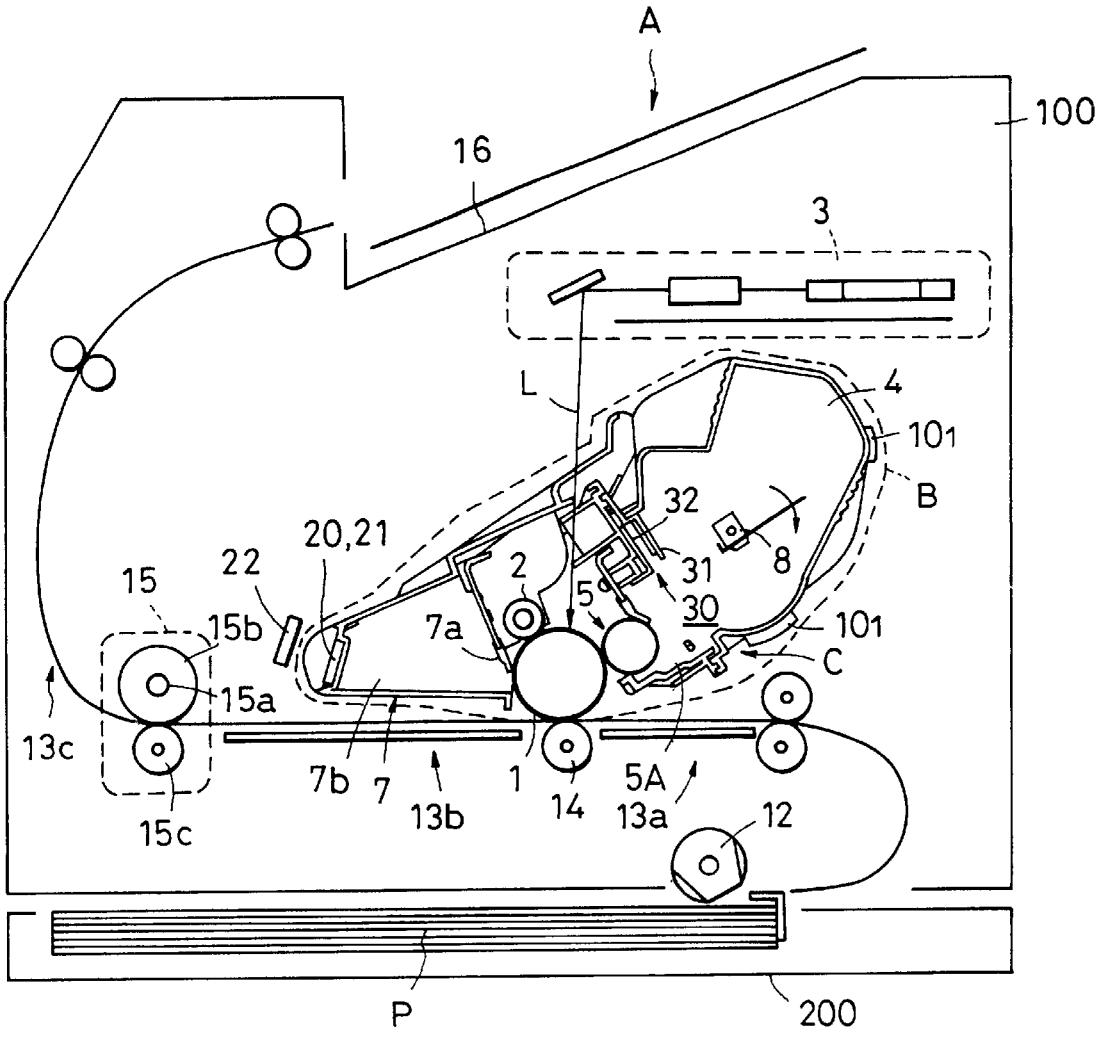
FIG. 1 is a sectional view of a process cartridge and an image forming apparatus in accordance with the present invention.
Figure 2:
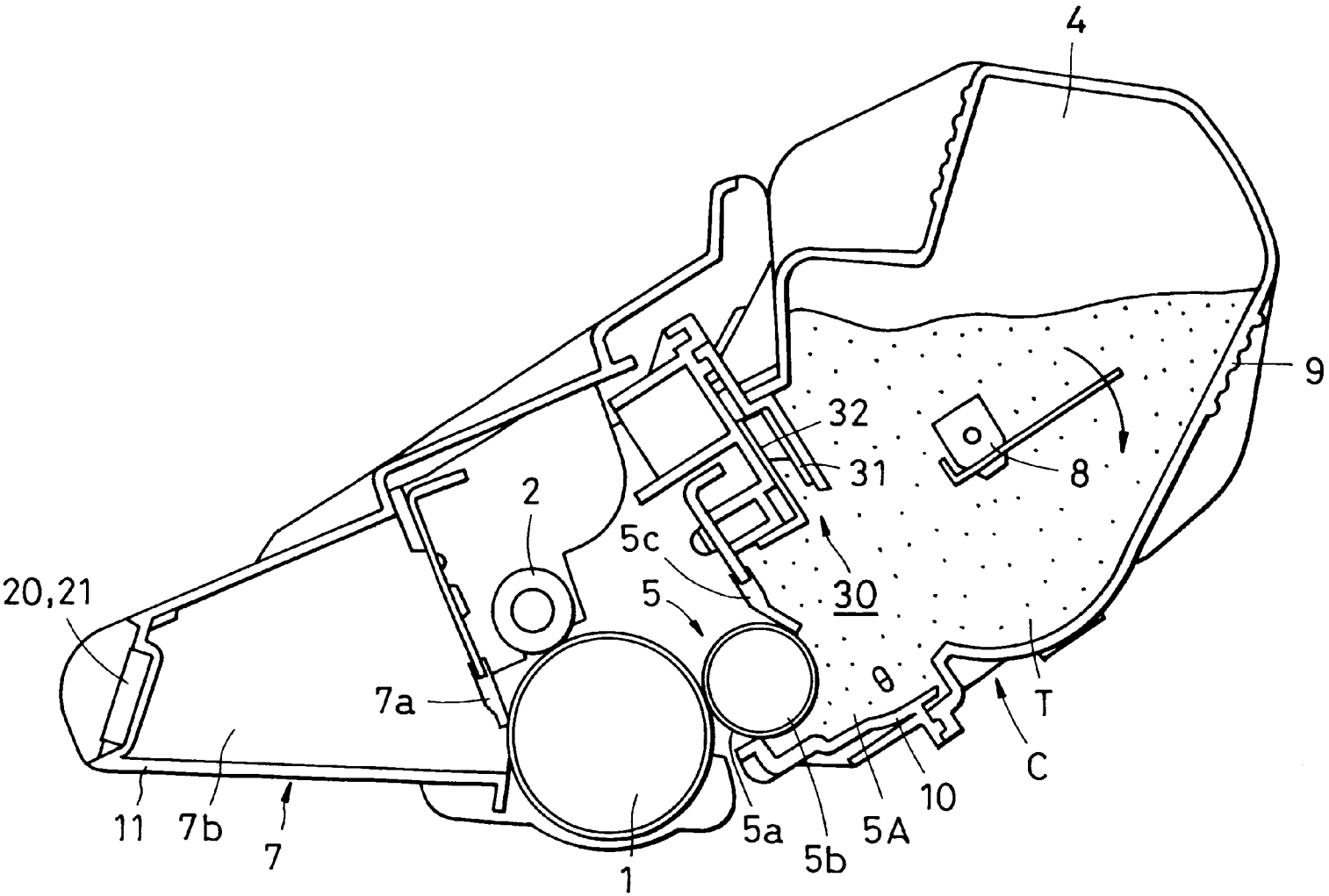
FIG. 2 is an enlarged sectional view of the process cartridge shown in FIG. 1.

Referring to FIG. 1 and FIG. 2, a description will be provided of an embodiment of an electrophotographic image forming apparatus in accordance with the present invention to which a process cartridge can be attached. In the present embodiment, the electrophotographic image forming apparatus is an electrophotographic laser beam printer A. The electrophotographic laser beam printer A receives image information from a host computer, and forms images on a recording material, for example, recording paper, OHP sheets, or cloth through electrophotographic image formation.

The laser beam printer (printer) A has a drum-shaped electrophotographic photosensitive body, that is, a photosensitive drum 1. The photosensitive drum 1 is charged by a charging roller 2 that is an charging means. Laser light L representing image information is projected from a laser scanner 3, whereby a latent image based on the image information is formed on the photosensitive drum 1. The latent image is developed by a developing means 5 included in a development unit C and thus changed to a visible image, that is, a toner image.

Figure 4:
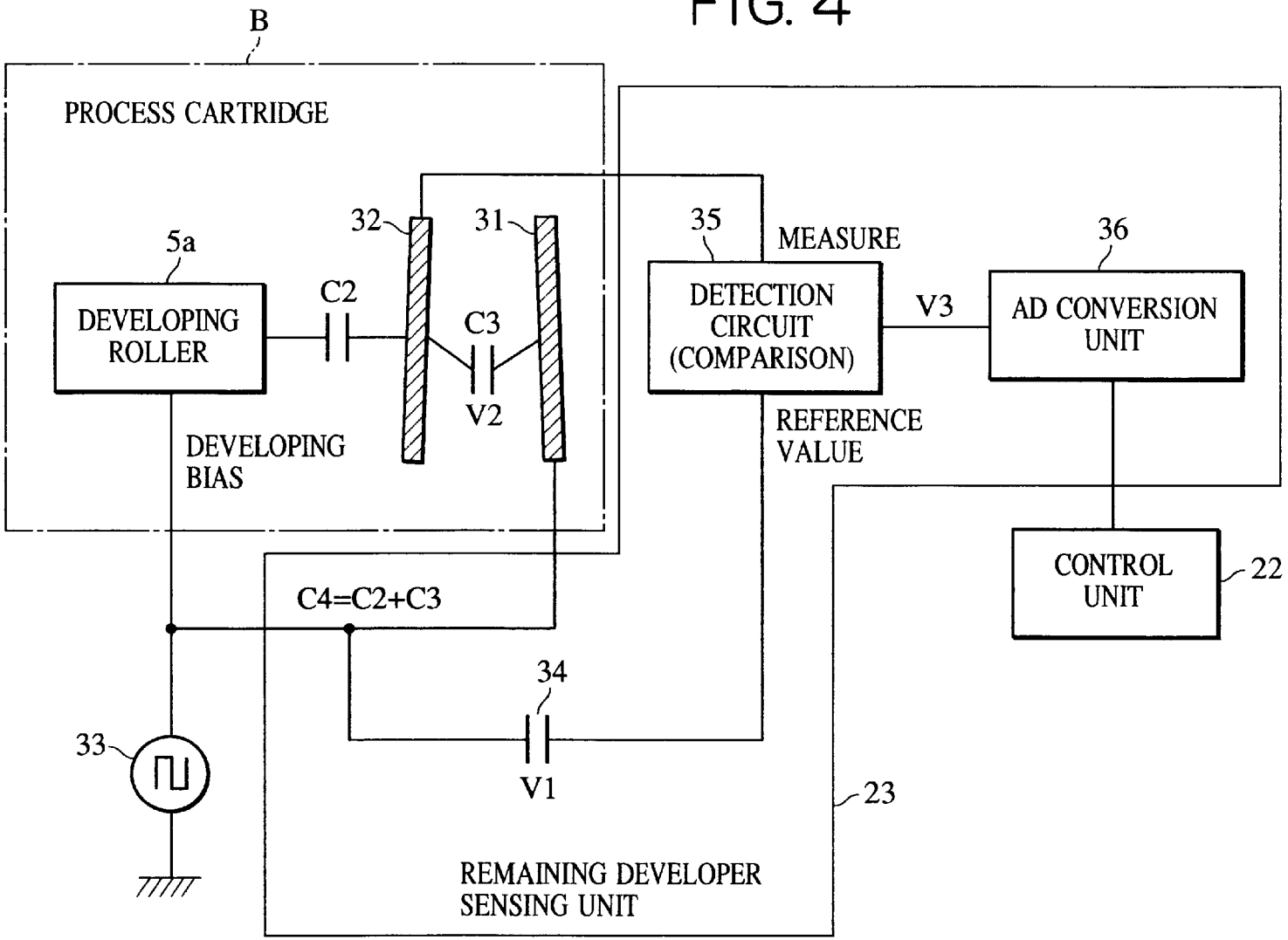
FIG. 4 shows the circuitry of an amount-of-remaining developer detector employed in the embodiment of the present invention.

The development unit C has a development chamber 5A and a developer container 4 as a developer storage device. The development chamber 5A accommodates a developing roller 5*a* that is a developer bearing member, and the developer container 4 is located adjacently to the development chamber 5A. A developer T stowed in the developer container 4 is fed to the developing roller 5*a* in the development chamber 5A. An agitating means 8 capable of rotating in a direction of an arrow in FIG. 1 is placed in the developer container 4. When the agitating means 8 is rotated, the developer T is agitated and fed to the developing roller 5*a*. According to the present embodiment, an insulating magnetic toner of a single component is used as the developer T. The developing roller 5*a* has a stationary magnet 5*b* incorporated therein. When the developing roller 5*a* is rotated, the developer is transported. A developing blade 5*c* serving as a developer layer thickness restricting member applies frictional electrification charge to the developer, and confines the layer of the developer to a predetermined thickness. The developer is then fed to a developing area on the photosensitive drum 1. The developer fed to the developing area is shifted to a latent image on the photosensitive drum 1, whereby a toner image is formed. The developing roller 5*a* is connected to a developing bias applying means 33 (FIG. 4). Normally, a developing bias voltage having a direct voltage superposed on an alternating voltage is applied to the developing roller 5*a*.

Responsively to formation of a toner image, a recording material P put in a paper feed cassette 200 is transported to a transferring position via a pickup roller 12 and a transporting means 13*a*. A transfer roller 14 that is a transferring means is located at the transferring position. With application of a voltage, the toner image on the photosensitive drum 1 is transferred onto the recording material P.

The recording material P onto which the toner image is transferred is transported to a fusing means 15 by a transporting means 13*b*. The fusing means 15 has a fusing roller 15*b* with a built-in heater 15*a* and a driving roller 15*c*. The fusing means applies heat and pressure to the passing recording material P, thus fusing the transferred-toner image on the recording material P.

The recording material P is ejected to an ejection tray 16 by a transporting means 13*c*. The ejection tray 16 is formed on the top of a main unit 100 of the laser beam printer A.

The photosensitive drum 1 from which the toner image is transferred onto the recording material P by the transfer roller 14 has the remaining developer removed by a cleaning means 7. Thereafter, the next image formation operation is carried out. The cleaning means 7 uses an elastic cleaning blade 7*a*, which is in contact with the photosensitive drum 1, to sweep away the developer remaining on the photosensitive drum 1 and gather it into a waste developer container 7*b*.

According to the present embodiment, a process cartridge B is, as shown in FIG. 2, made by unifying the development unit C and a cleaning frame 11. The development unit C is made by welding a developer frame 9 and a development frame 10. The developer frame 9 outlines the developer container 4 in which the developer is stowed and the agitating means 8 is included. The development frame 10 outlines the development chamber 5A in which the developing means 5 composed of the developing roller 5*a* and developing blade 5*c* is held. The photosensitive drum 1, the cleaning means 7 composed of the cleaning blade 7*a* and waste developer container 7*b*, and the charging roller 2 are mounted on the cleaning frame 11. A user engages the process cartridge B with cartridge attaching means 101 (FIG. 1) formed in the main unit 100 so that the process cartridge can be disengaged therefrom.

According to the present embodiment, the process cartridge B has a programmable memory 20, which serves as a memory means 20, and a transmission unit 21, which controls reading and writing of information from and in the memory 20, formed on the side surface of the waste developer container 7*b*. When the process cartridge B is attached to the main unit 100, the transmission unit 21 is opposed to a control unit 22 incorporated in the main unit 100. The control unit 22 fills the role of a transmitting means incorporated in the main unit 100.

The memory 20 is thus placed on the upper side surface of the waste developer container 7*b*. This is because according to the present embodiment, the process cartridge B is inserted into the laser beam printer A with the waste developer container 7*b* first brought into contact with the main unit 100. Consideration is therefore taken so that the transmission unit 21 adjoining the memory 20 in the cartridge will be aligned with the communicating means realized with the control unit 22 incorporated in the main unit 100. The transmission unit 21 and control unit 22 constitute a control means for reading or writing information from or in the memory.

A combination of a nonvolatile memory or a volatile memory and a backup battery or any other electronic memory realized with semiconductors may be adopted as the memory means 20 employed in the present invention without restriction. In particular, when the memory 20 is a noncontact memory in which data communication between reading and writing ICs is achieved using electromagnetic waves, the transmission unit 21 included in the cartridge and the control unit 22 included in the main unit may be not in contact with each other. This obviates the possibility that the process cartridge B may be attached and brought into imperfect contact with the main unit. The control means composed of the transmission unit and control unit can extend control highly reliably. According to the present embodiment, a noncontact memory is adopted as the memory 20.

The storage capacity of the memory 20 is large enough to store a plurality of items of information including information of the use situation of the cartridge that will be described later and a characteristic value indicating the characteristic of the cartridge. Information of the use time of the cartridge can be written or stored any time in the memory 20.

According to the present invention, the image forming apparatus can sense an amount of remaining developer and the use times of the other consumables, output the information of the amount of remaining developer and the use times, and mutually independently report the amount of remaining developer and the use times of the consumables.

Figure 3:
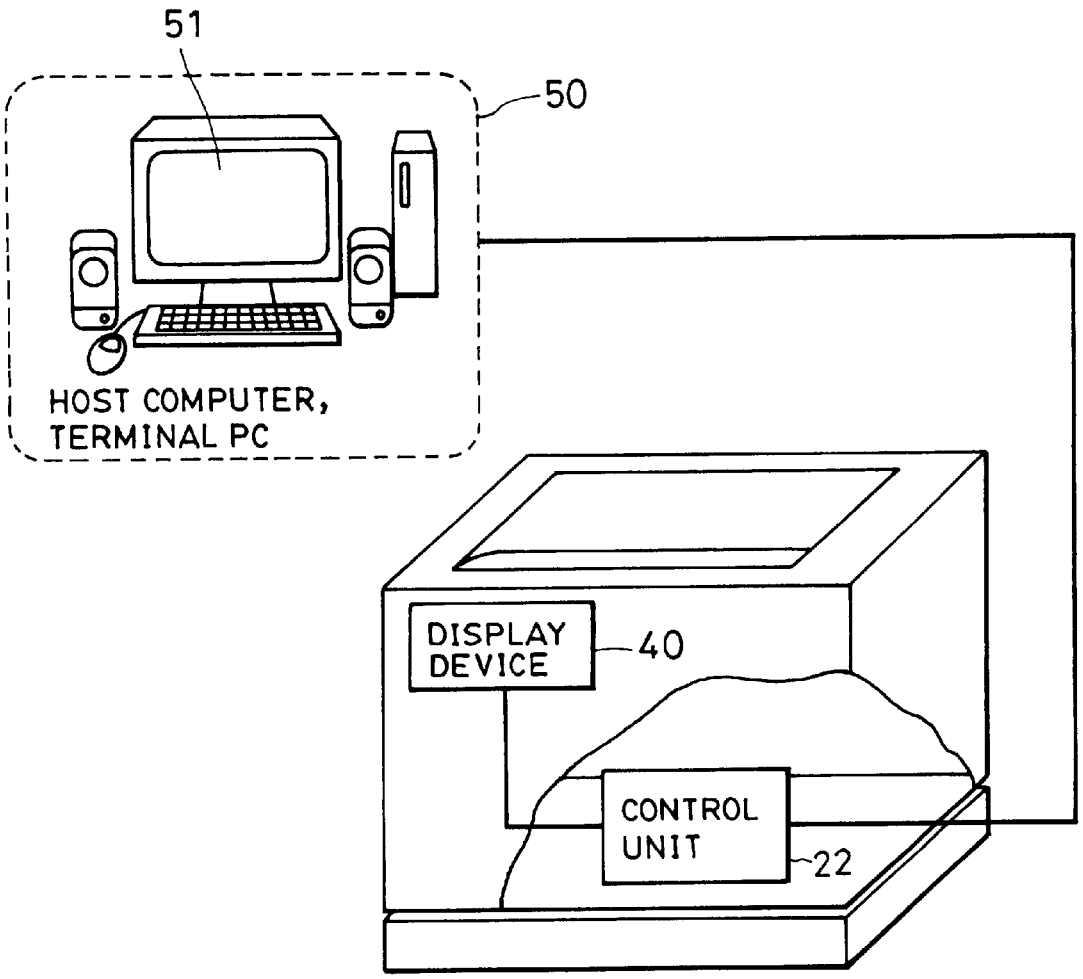
FIG. 3 schematically shows the configuration of a use-situation reporting system for reporting the amount of remaining developer and the use times of the other consumables in accordance with an embodiment of the present invention.

To be more specific, according to the present embodiment, an amount of remaining developer is sensed regularly, and the use time of the photosensitive drum 1 is sensed regularly. These two parameters are output mutually independently. According to the present embodiment, the results of sensing are mutually independently output to the main unit 100 and to host 50, that is a host computer or a terminal personal computer connected to the main unit 100, in order to communicate with the main unit 100 over a network. The results of sensing, that is the parameters, are then indicated on a display device 40 included in the main unit and on a display device 51 (FIG. 3) included in the host 50 (FIG. 3).

According to the present embodiment, the sensed amount of remaining developer is indicated in the form of a remaining developer ratio that is decremented from 100% to 0% with the progress of consumption of the developer. The use time of the photosensitive drum 1 is indicated in the form of a use ratio that is started with 0% and incremented with the progress of use of the photosensitive drum 1.

The service life of the process cartridge B is managed based on the sensed amount of remaining developer. The use time of the photosensitive drum 1 is indirectly related to the service life of the process cartridge B. For example, if a user complains to a manufacturer, the use situations of the consumables other than the developer accommodated by the process cartridge B are judged from the use time of the photosensitive drum.

Specifically, the process cartridge B employed in the present embodiment is designed so that as long as the process cartridge is used in a general manner, unless the developer runs out, the service life of the photosensitive drum 1 will not complete its life span. For example, a user may keep forming images by producing a small number of printouts, whose print (image) ratio is low, at every time (in a low print ratio mode). In this case, the service life of the photosensitive drum 1 may complete its life span before the developer runs out.

In the present embodiment, the amount of remaining developer used as an index for managing the service life of the process cartridge B when the printer is used in a normal manner shall be referred to as a parameter used to directly manage the service life of the cartridge. If a user complains to a manufacturer, the parameter is used as a criterion for the use situations of the other consumables. The use time of the photosensitive drum 1 shall be referred to as a parameter indirectly related to the service life of the cartridge.

FIG. 3 shows a use-situation reporting system in accordance with the present invention for reporting an amount of remaining developer and the use times of the other consumables. In the present embodiment, the control unit 22 in the main unit for controlling actions performed in the image forming apparatus in a centralized manner calculates an amount of remaining developer and the use time of the photosensitive drum 1. A remaining developer ratio (%) that is the ratio of the amount of remaining developer to an amount of unused developer and a, photosensitive drum use ratio (%) that is the ratio of the photosensitive drum 1 to a threshold are then determined. Thereafter, the control unit outputs the two items of information mutually independently. Consequently, the information of the amount of remaining developer and the information of the use time of the photosensitive drum 1 are sent to the display device 40 and display device 51, and displayed when needed by a user. The display device 40 is a display panel or the like included in the main unit 100, while the display device 51 is included in the host 50 connected to the main unit 100 in order to communicate with the main unit 100.

A method of sensing an amount of remaining developer that is a parameter used to directly manage the service life of the process cartridge B will be described below.

According to the present embodiment, the laser beam printer A has an amount-of-developer detector including the remaining developer sensing means 30 capable of sensing an amount of developer T stowed in the development unit C regularly along with consumption of the developer T.

According to the present embodiment, a plate antenna type sensor is used as the remaining developer sensing means 30. As shown in FIG. 2, in the present embodiment, an output sheet metal 32 and an input sheet metal 31 constituting a plate antenna are opposed to the developing roller 5*a*. The output sheet metal 32 extends over the longitudinal direction of the development unit C, and the input sheet metal 31 has substantially the same longitudinal length as the output sheet metal 32 and is opposed to the output sheet metal 32.

When the plate antenna type sensor is adopted as the remaining developer sensing means 30, the input sheet metal 31 and output sheet metal 32 constituting the plate antenna are located in the development unit C. An alternating voltage is applied to an electrostatic capacitor composed of the developing roller 5*a* and output sheet metal 32 and to an electrostatic capacitor composed of the input sheet metal 31 and output sheet metal 32. An electrostatic capacitance exerted between the developing roller 5*a* and output sheet metal 32, and an electrostatic capacitance exerted between the input sheet metal 31 and output sheet metal 32 are varied with a decrease in the amount of developer T contained in the development unit C. The amount of developer contained in the development unit C can therefore be calculated by measuring the electrostatic capacitances. An alternating current derived from application of the alternating voltage is measured to calculate the amount of developer.

The input sheet metal 31 and output sheet metal 32 constituting the plate antenna may be made of any material as long as the material can conduct current. According to the present embodiment, the sheet metals 31 and 32 are formed with silicon unilateral switches (SUSs) that are resistive to rust.

Referring also to FIG. 4, the circuitry of the amount-of-developer detector will be described below. According to the present embodiment, the developing roller 5*a* and input sheet metal 31 are electrically connected to the developing bias circuit 33 with the process cartridge B attached to the main unit 100. The developing bias circuit 33 is the developing bias applying means, or in other words, a voltage applying means and is incorporated in the main unit 100.

The developing bias circuit 33 outputs a predetermined alternating bias. The bias is applied to a reference capacitor 34, the developing roller 5*a*, and the input sheet metal 31. Consequently, a voltage V1 develops across the reference capacitor 34, and a current proportional to an electrostatic capacitance C4 flows between the input sheet metal 31 and output sheet metal 32. Arithmetic operations are performed in order to convert the current value into a voltage V2. The electrostatic capacitance C4 is the sum of an electrostatic capacitance C2 exerted between the developing roller 5*a* and output sheet metal 32 and an electrostatic capacitance C3 exerted between the input sheet metal 31 and output sheet metal 32.

A detection circuit 35 produces a voltage V3 corresponding to a difference between the voltage V1 developed across the reference capacitor 34 and the voltage V2 into which the current flowing between the input sheet metal 31 and output sheet metal 32 is converted. The voltage V3 is output to an A/D conversion unit 36. The A/D conversion unit 36 digitizes the analog voltage V3 and outputs a digital voltage level to the control unit 22. The control unit 22 recognizes an amount of developer within the process cartridge B according to the digital voltage level.

According to the present embodiment, electrostatic capacitances detected by the remaining developer sensing means 30 are converted into a voltage by a remaining developer sensing unit 23 included in the main unit 100. The remaining developer sensing unit 23 consists of the reference capacitor 34, detection circuit 35, and A/D conversion unit 36. The voltage is then input to the control unit 22.

According to the present embodiment, when an amount of developer is the largest, the detected voltage V3 assumes the lowest level (the sum of electrostatic capacitances is the largest) that shall be referred to as a plate antenna full (PAF) level. The PAF voltage level is sensed when the space between the developing roller 5*a* and output sheet metal 32 and the space between the input sheet metal 31 and output sheet metal 32 are filled with the developer. In the present embodiment, the PAF voltage level is written in the memory 20 included in the process cartridge B. When the laser beam printer A is in operation, the detected voltage V3 assumes the lowest voltage level (the sum of electrostatic capacitances is the largest). The PAF voltage level stored in the memory 20 is then updated. When no developer is poured, the detected voltage V3 assumes the highest voltage level (sum of electrostatic capacitances is the smallest) that shall be referred to as a plate antenna empty (PAE) voltage level. The PAE voltage level is stored in the memory 20 included in the process cartridge B at a factory.

The remaining developer sensing means 30 for sensing an amount of developer is controlled as described below. That is to say, the control unit 22 included in the main unit 100 uses the PAF and PAE voltage levels stored in the memory 20 to determine a usable range of amounts of developer within the process cartridge B. Correction values are successively assigned to a weight function relative to which the function of the amount of remaining developer to the PAE voltage level and the function thereof to the PAF voltage level are orthogonal. A correction value permitting the weight function to represent the relationship to the detected voltage V3 is found out. As the correction value of the weight function, a plurality of correction values is predefined to be associated with amounts of developer falling within the usable range and having a proper difference between adjoining ones. The found correction value relative to the voltage V3 is converted into an amount of remaining developer using a correction table in which the correction values are listed in association with amounts of remaining developer that get smaller with the progress of use of the developer. The retrieved amount of remaining developer is indicated on the display device 40 included in the main unit and the display device 51 included in the host 50 when needed by a user. According to the present embodiment, the amount of remaining developer is indicated in the form of the ratio of the amount of remaining developer to the amount of developer filling the container (an amount of unused developer).

Incidentally, the usable range of amounts of developer, the weight function, and the relationship to a detected voltage represented by the weight function are pre-set properly according to the characteristics of the process cartridge B.

Figure 5:
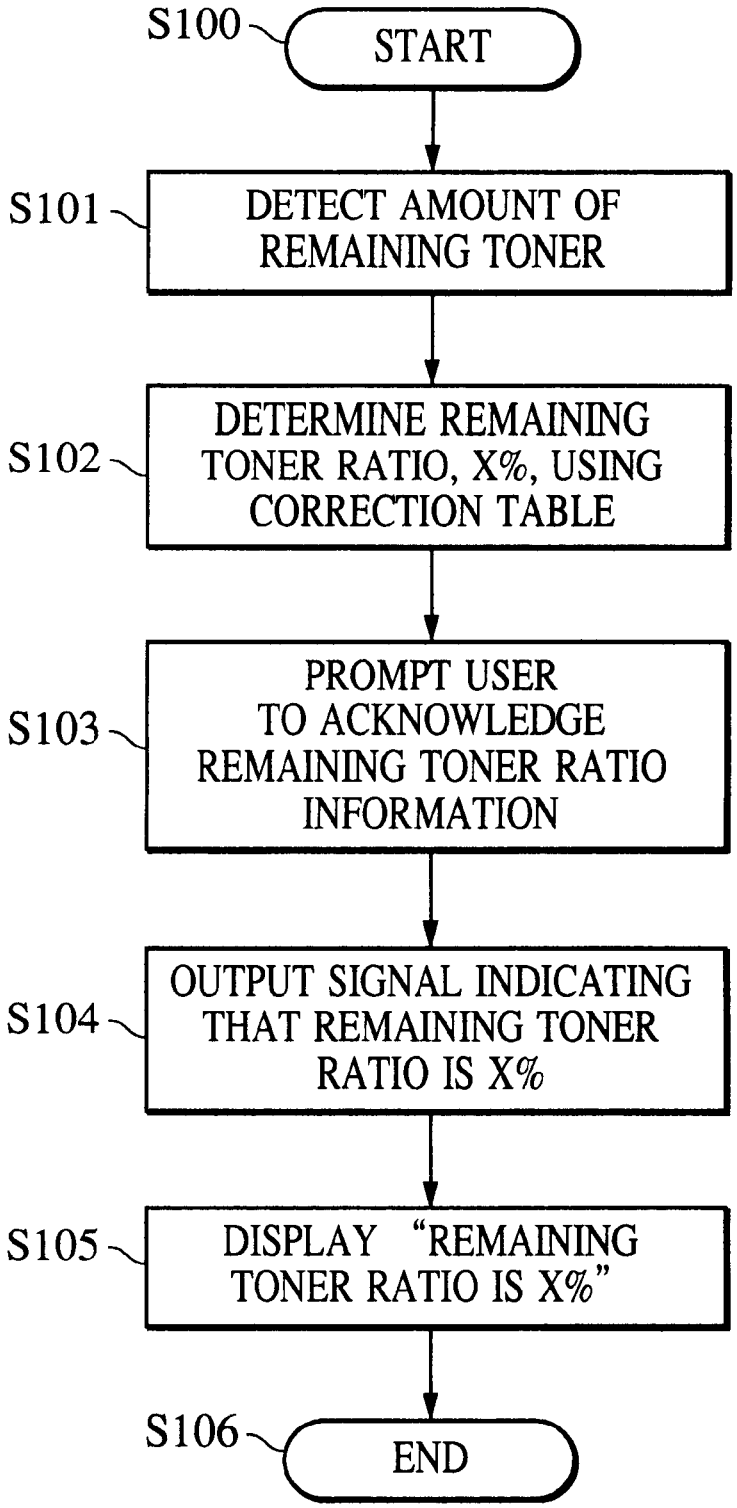
FIG. 5 is a flowchart for explaining an example of an action of indicating the amount of remaining developer in accordance with the present invention.

Next, a method of indicating a sensed amount of remaining developer, which is employed in the present embodiment, will be described with reference to the flowchart of FIG. 5.

At step S100, a sequence is started.

At step S101, the control unit 22 included in the main unit calculates an amount of remaining developer.

At step S102, the control unit 22 references the correction table to retrieve X% as a remaining developer ratio that is the ratio of the amount of remaining developer to an amount of unused developer.

At step S103, a user acknowledges the remaining developer ratio indicated on the display device 40 of the main unit and the display device 51 of the host 50. Consequently, an acknowledge signal for acknowledging the remaining developer ratio is set to an on voltage level.

At step S104, the control unit 22 transmits a remaining developer ratio signal, which indicates that the remaining developer ratio is X%, to the display devices 40 and 51.

At step S105, a message "The remaining developer ratio is X%." is displayed on the display devices 40 and 51.

At step S106, the sequence is terminated.

Figure 6:
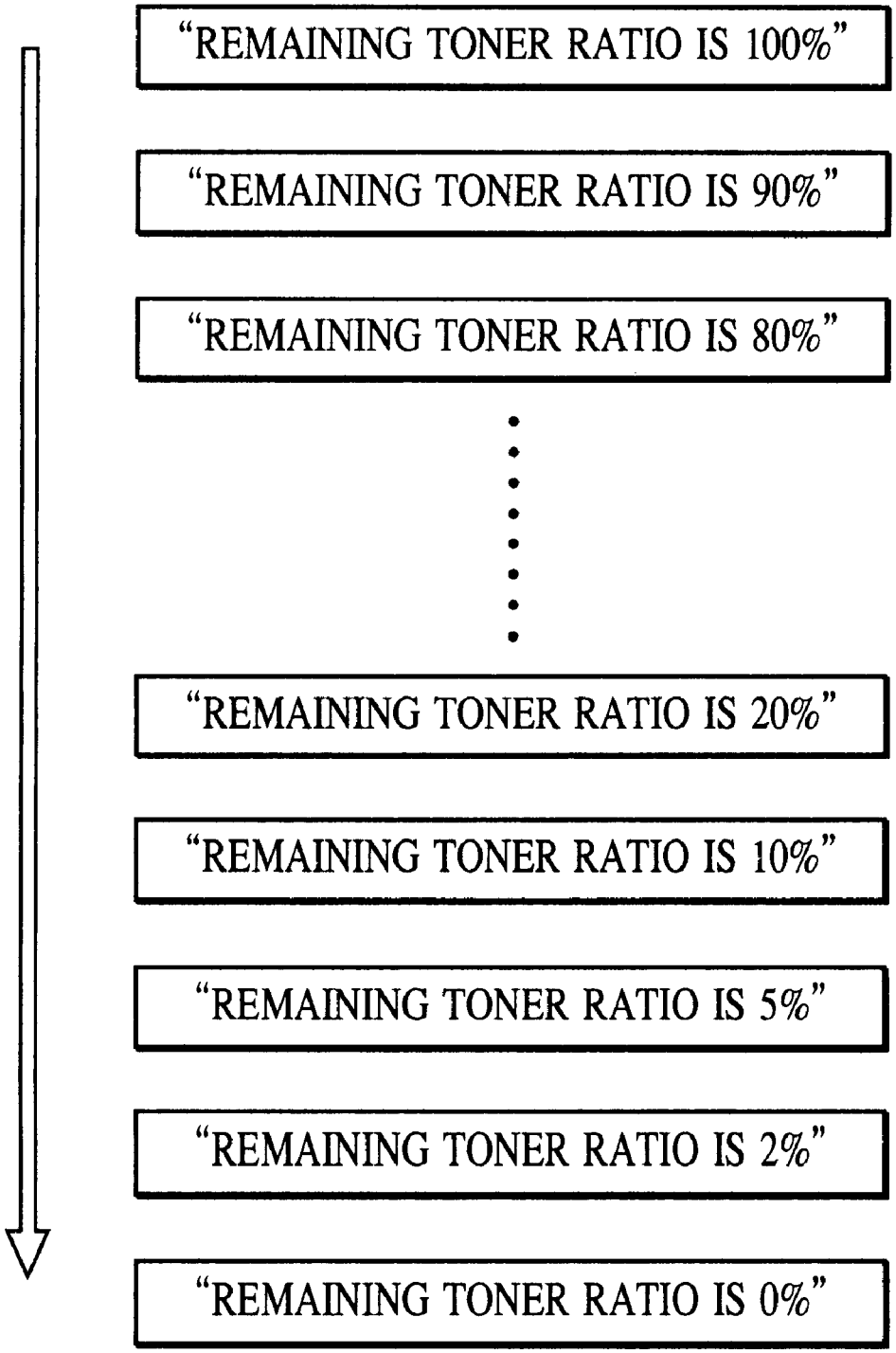
FIG. 6 is an explanatory diagram concerning an example of an indication of the amount of remaining developer in accordance with the present invention.

To be more specific, as shown in FIG. 6, when an amount of remaining developer is indicated on the display device 40 of the main unit and the display device 51 of the host 50, it is indicated in the form of a remaining developer ratio. The remaining developer ratio is decremented sequentially with the progress of consumption of the developer, and reported to a user. For example, "The remaining toner ratio is 100%." signifying that the remaining developer ratio is 100% is changed to "The remaining toner ratio is 90%." signifying that the remaining developer ratio is 90%. "The remaining toner ratio is 90%." is then changed to "The remaining toner ratio is 80%." signifying that the remaining developer ratio is 80%.

As mentioned above, the remaining developer ratio is decremented with a decrease in the amount of remaining developer, and indicated accordingly. Thus, the information of the service life of the process cartridge B can be concisely provided for a user.

According to the present embodiment, when the remaining developer ratio becomes 0%, for example, a message "No toner. Change the cartridge." is displayed in order to report a user the fact that the service life of the process cartridge B has completed its life span.

Next, a method of sensing the use time of the photosensitive drum 1 that is a parameter indirectly related to the service life of the process cartridge B will be described below.

An inductive light conducting (OPC) layer of a photosensitive body consists mainly of a charge transporting (CT) layer and a charge generating (CG) layer. The service life of the photosensitive body generally depends on a decrease in the thickness of the CT layer (a scrape on the CT layer). Image quality deteriorates with the decrease in the thickness.

What is conceivable as a factor of the scrape on the CT layer is electric abrasion caused by mechanical friction of a part in contact with the CT layer and discharge. The use time of the photosensitive drum 1 is therefore calculated based on the rotation time of the photosensitive drum 1 that correlates to the magnitude of the scrape on the CT layer, and the application time during which a charging bias is applied to the charging roller 2. The thus calculated use time of the photosensitive drum 1 is corrected using a threshold for the use time of the photosensitive drum 1 stored in the memory 20 included in the process cartridge B. In other words, the ratio of the calculated use time to the threshold is calculated as a use ratio. Incidentally, the threshold for the use time of the photosensitive drum 1 is an experimentally predefined value and comparable to a use time for which the manufacturer guarantees the performance of the photosensitive drum 1. According to the present embodiment, the use time of the photosensitive drum is stored as a characteristic value of the process cartridge B in the memory 20 included in the process cartridge B.

To be more specific, according to the present embodiment, an arithmetic unit included in the control unit 22 calculates a use time D of the photosensitive drum 1 according to the following conversion formula:

$$D=A+B\times\phi$$

where B denotes a value calculated by integrating rotation times of the photosensitive drum 1, A denotes a value calculated by integrating application times of the charging bias and $\phi$ denotes a predefined weighting factor. The results of calculation are stored in the memory 20 included in the process cartridge B. According to the present embodiment, the rotation time of the photosensitive drum 1 and the application time of the charging bias are stored in the memory 20 whenever it is needed. The use time of the photosensitive drum 1 is calculated when driving the photosensitive drum 1 is halted.

The ratio of the use time D of the photosensitive drum 1 provided by the conversion formula to the threshold for the use time of the photosensitive drum stored in the memory 20 is calculated as a use ratio. The calculated use ratio is indicated on the display device 40 of the main unit and the display devices 51 of the host 50 when needed by a user. As mentioned above, the use ratio of the photosensitive drum 1 is incremented with the progress of use of the photosensitive drum, and indicated on a display means composed of the display device 40 of the main unit and the display device 51 of the host 50 whenever it is needed.

Figure 7:
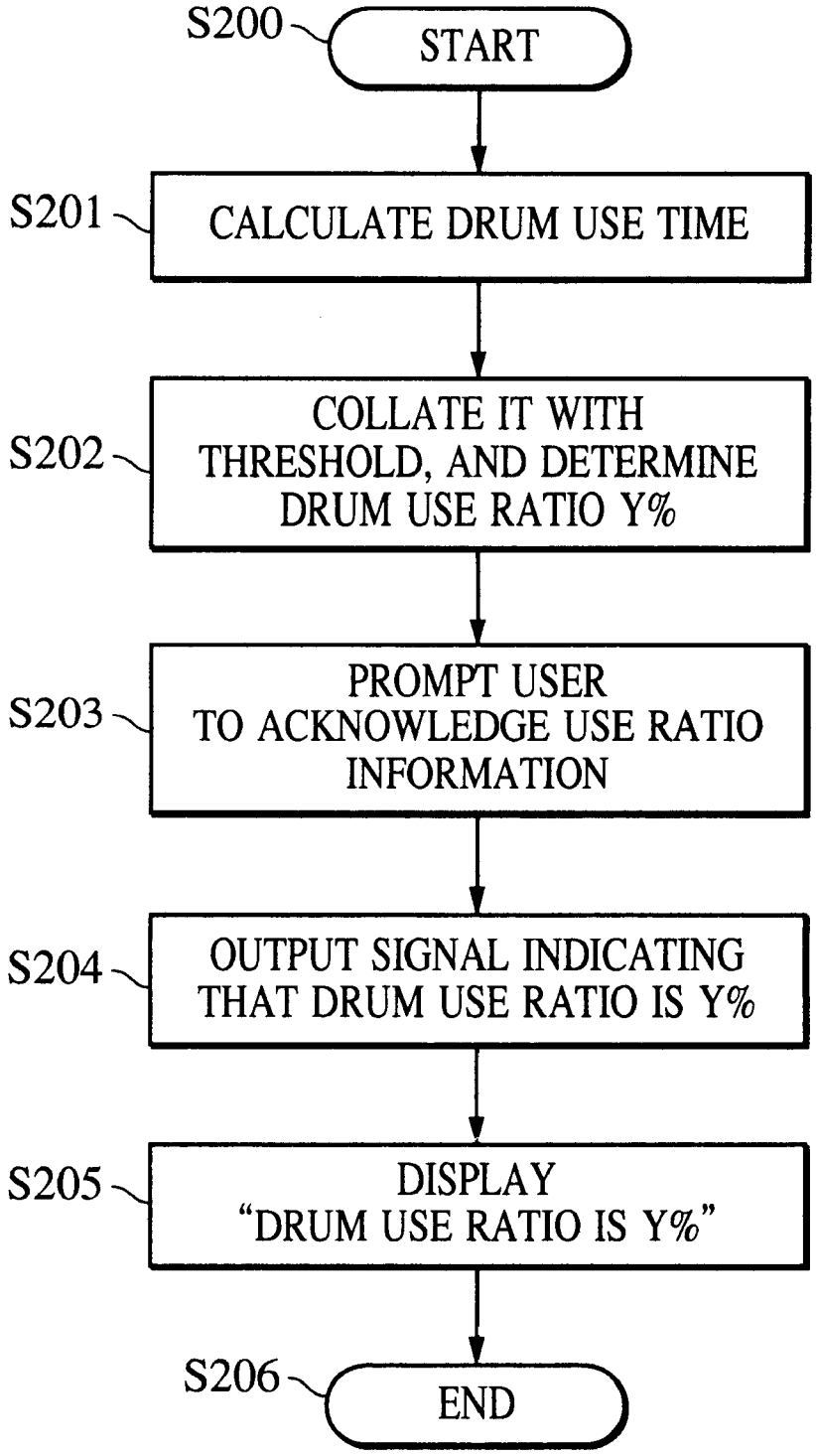
FIG. 7 is a flowchart describing an example of an action of indicating the use time of a photosensitive drum in accordance with the present invention.

A method of indicating the use time of the photosensitive drum 1 will be described with reference to the flowchart of FIG. 7.

At step S200, a sequence is started.

At step S201, the control unit 22 calculates the use time of the photosensitive drum 1.

At step S202, the control unit 22 collates the use time of the photosensitive drum 1 calculated at step S201 with the threshold for the use time stored in the memory 20 included in the process cartridge B, and thus determines Y% as a drum use ratio.

At step S203, a user acknowledges the use ratio of the photosensitive drum 1 indicated on the display device 40 of the main unit and the display device 51 of the host 50. Consequently, an acknowledge signal for acknowledging the use ratio is set to an on voltage level.

At step S204, the control unit 22 transmits a use ratio signal, which indicates that the photosensitive drum use ratio is Y%, to the display devices 40 and 51.

At step S205, a message "The photosensitive drum use ratio is Y%." is displayed on the display devices 40 and 50.

At step S206, the sequence is terminated.

Figure 8:
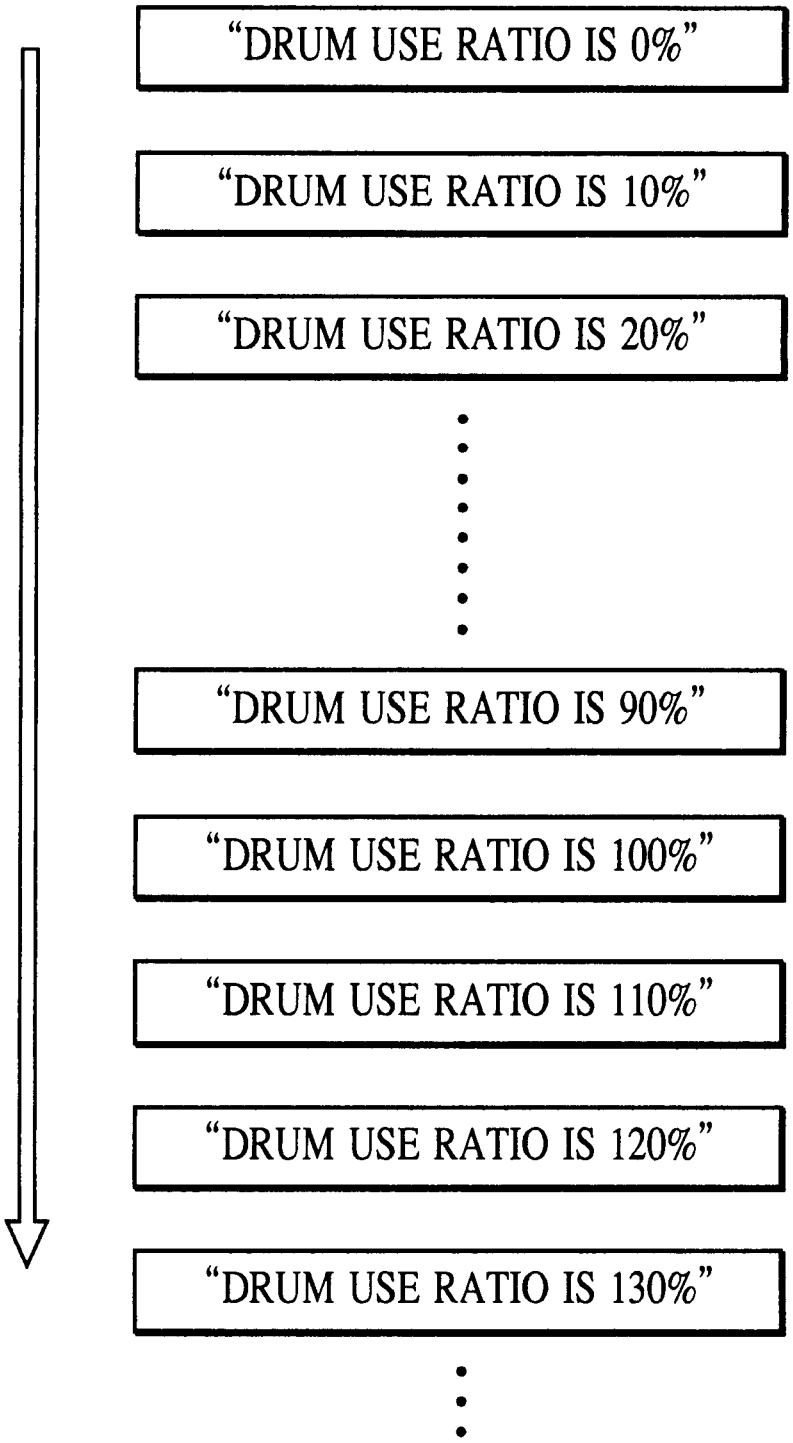
FIG. 8 is an explanatory diagram for explaining an example of an indication of the use time of the photosensitive drum in accordance with the present invention.

To be more specific, as shown in FIG. 8, when the use time of the photosensitive drum 1 is indicated on the display device 40 of the main unit and the display device 51 of the host 50, it is indicated in the form of a use ratio. The use ratio is incremented with the progress of use of the photosensitive drum, and thus reported to a user. For example, "The photosensitive drum use ratio is 0%." signifying that the use ratio of the photosensitive drum 1 is 0% is changed to "The photosensitive drum use ratio is 10%." signifying that the use ratio of the photosensitive drum 1 is 10%. "The photosensitive drum use ratio is 10%." is then changed to "The photosensitive drum use ratio is 20%." signifying that the use ratio of the photosensitive drum 1 is 20%. Even when the service life of the photosensitive drum 1 during which a manufacturer guarantees the performance of the photosensitive drum 1 has completed its life span, that is, the use ratio of the photosensitive drum 1 exceeds 100%, the use ratio of the photosensitive drum 1 is calculated. For example, a message "The photosensitive drum use ratio is 130%." signifying that the use ratio of the photosensitive drum 1 is 130% is displayed.

The use ratio of the photosensitive drum 1 indirectly related to the service life of the process cartridge B is incremented with 1he progress of use of the photosensitive drum 1, and then indicated. This helps prevent a user from getting confused by the information of the service life. The use ratios of consumables can be concisely provided for a user whenever needed. If a user complains to a manufacturer, the use ratio of the photosensitive drum 1 is used as a criterion for the use situation of the photosensitive drum 1 representative of the use situations of consumables other than a developer within the process cartridge B. For example, a serviceperson can give adequate advice to a user.

As mentioned above, according to the present embodiment, the amount of remaining developer, that is a parameter used to directly manage the service life of the process cartridge B, is indicated in the form of a remaining developer ratio that is decremented stepwise. The use time of the photosensitive drum 1, that is a parameter indirectly related to the service life of the process cartridge B, is indicated in the form of a use ratio that is incremented stepwise.

The amount of remaining developer and the use time of the photosensitive drum are adopted as parameters. Therefore, for example, if a user using the printer A in a low print ratio mode complains to a manufacturer about poor quality images, the use time of the photosensitive drum 1 can be reported to the user. Thus, the use situation of the process cartridge B is reported to the user. Consequently, the number of returned process cartridges B can be decreased. Moreover, when the parameters are reported to a user, a manufacturer can grasp the contents of a user's complaint over a communication network such as a telephone line. Moreover, the number of times that a serviceperson must visit the user to understand the state of the process cartridge B can be decreased. Consequently, robust service can be provided efficiently and swiftly.

According to the present invention, the amount of remaining developer and the use times of the other consumables are indicated. Thus, the timing of replacing a cartridge with a new one can be accurately reported to a user. Consequently, the user's convenience improves.

Second Embodiment

Next, another embodiment of the present invention will be described. An image forming apparatus of the present embodiment has basically the same configuration as that of the first embodiment. The same reference numerals will be assigned to members having the same capabilities and structures. The description of the members will be omitted, and only constituent features of the present embodiment will be described below.

According to the present embodiment, the amount of remaining developer is sensed regularly. The use time of the photosensitive drum 1 and the use time of the developing roller 5*a* are sensed regularly as the use times of the other consumables. These three parameters are output mutually independently. According to the present embodiment, the results of sensing are output to the main unit 100 and the host 50 that is a host computer or a terminal personal computer connected to the main unit in order to communicate with the main unit over a network. The three parameters are then indicated on the display device 40 of the main unit and the display device 51 of the host 50.

According to the present embodiment, the amount of remaining developer is adopted as a parameter used to directly manage the service life of the process cartridge B. The use time of the photosensitive drum 1 and the use time of the developing roller 5*a* are adopted as parameters indirectly related to the service life of the process cartridge B. When a user complains to a manufacturer, the parameters are used as criteria for the use situations of the consumables accommodated by the process cartridge B.

The sensed amount of remaining developer is indicated in the form of a remaining developer ratio that is decremented stepwise from 100% to 0% with the progress of use of the developer. The sensed use times of the photosensitive drum 1 and developing roller 5*a* are indicated in the form of use ratios that start at 0% and are incremented stepwise with the progress of use of the photosensitive drum and developing roller.

A mechanism for sensing the amount of remaining developer and a mechanism for sensing the use time of the photosensitive drum 1 which are employed in the present embodiment are identical to those employed in the first embodiment. Only a method of sensing the use time of the developing roller 5*a* will be described below.

According to the present embodiment, the developing roller 5*a* is made by coating a mirror-surface aluminum pipe with dispersed spherical carbon particles and a dispersed charge control agent. The dispersed spherical carbon particles provide roughness, whereby the amount of toner with which the developing roller 5*a* is coated is controlled. The service life of the developing roller 5*a* depends on degradation in the roughness of the surface of the developing roller 5*a* and contamination of the developing roller 5*a*. As the roughness is degraded, the image density deteriorates. The contamination of the developing roller 5*a* causes irregular images.

One of the factors of degrading the roughness of the surface of the developing roller 5*a* is abrasion caused by a developer or a restriction blade. The use time of the developing roller 5*a* is calculated by detecting the rotation time of the developing roller 5*a* which correlates to abrasion. The thus calculated use time of the developing roller 5*a* is corrected based on a threshold for the use time of the developing roller 5*a* that is stored in advance, for example, in the memory 20 included in the process cartridge B. Namely, the ratio of the calculated use time to the threshold is calculated as a use ratio. The threshold for the use time of the developing roller 5*a* is an experimentally predefined value, and comparable to the use time of the developing roller 5*a* for which a manufacturer guarantees the performance of the developing roller 5*a*. According to the present embodiment, the threshold is stored as a characteristic value of the process cartridge B in the memory 20 included in the process cartridge B.

According to the present embodiment, the use time of the developing roller 5*a* is calculated in the form of a use ratio using the rotation time of the developing roller 5*a* and the threshold for the use time of the developing roller 5*a* stored in the memory 20. The calculated use ratio is indicated on the display device 40 of the main unit and the display device 51 of the host when needed by a user. The use ratio of the developing roller 5*a* is, as mentioned above, incremented with the progress of use of the developing roller, and indicated by the display means composed of the display device 40 of the main unit and the display device 51 of the host 50.

Figure 9:
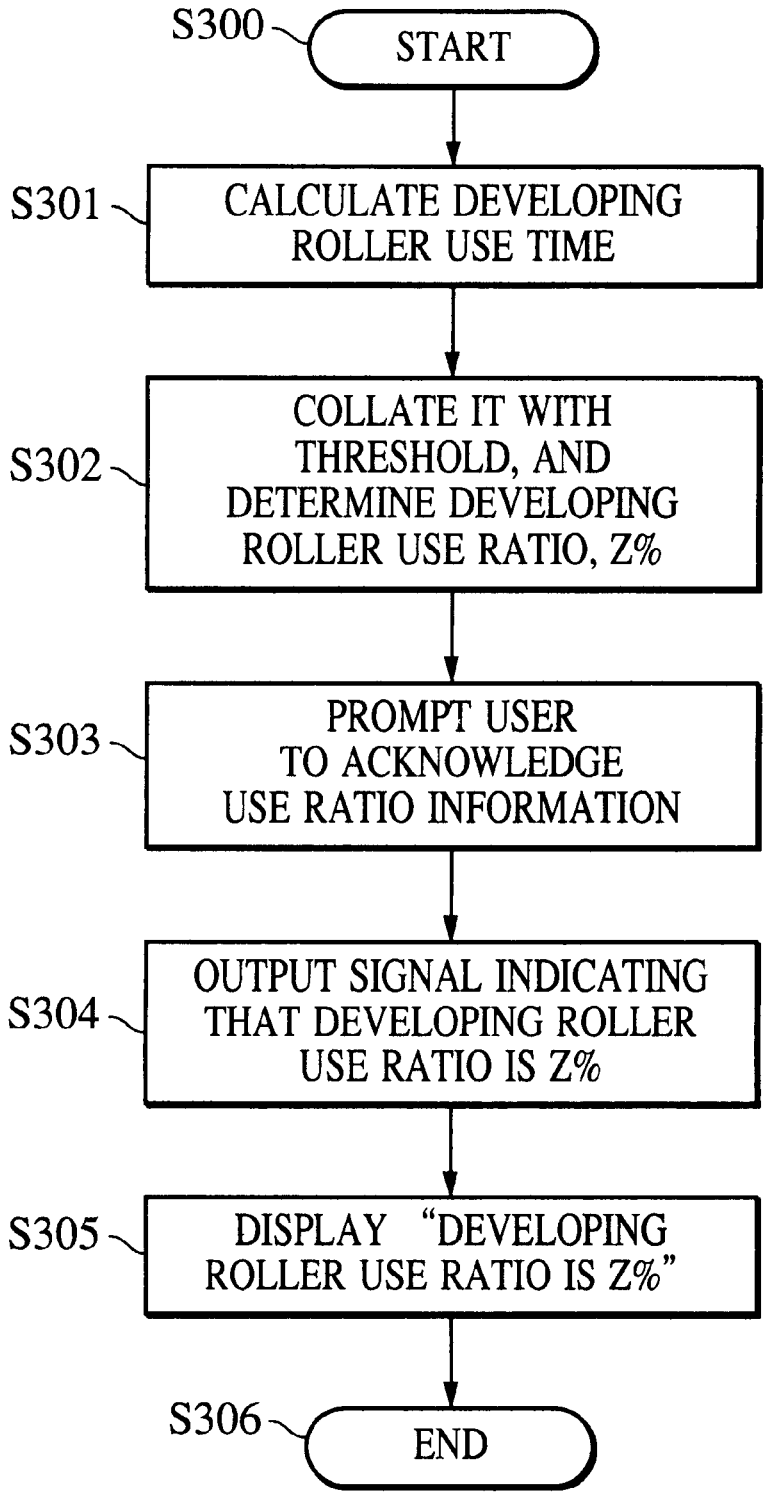
FIG. 9 is a flowchart describing an example of an action of indicating the use time of a developing roller in accordance with the present invention.

Referring to the flowchart of FIG. 9, a method of indicating the use time of the developing roller 5*a* will be described below.

At step S300, a sequence is started.

At step S301, the control unit 22 calculates the use time of the developing roller 5*a*.

At step S302, the control unit 22 collates the use time of the developing roller calculated at step S301 with the threshold for the use time stored in the memory 20 included in the process cartridge B, and thus determines Z% as the use ratio of the developing roller 5*a*.

At step S303, a user acknowledges the use ratio of the developing roller included in the development unit C which is indicated on the display device 40 of the main unit and the display device 51 of the host 50. Consequently, an acknowledge signal for acknowledging the use ratio of the developing roller is set to an on voltage level.

At step S304, the control unit 22 transmits a use ratio signal, which indicates that the developing unit use ratio is Z%, to the display devices 40 and 51.

A step S305, the display devices 40 and 51 display a message "The developing unit use ratio is Z%."

At step S306, the sequence is terminated.

Figure 10:
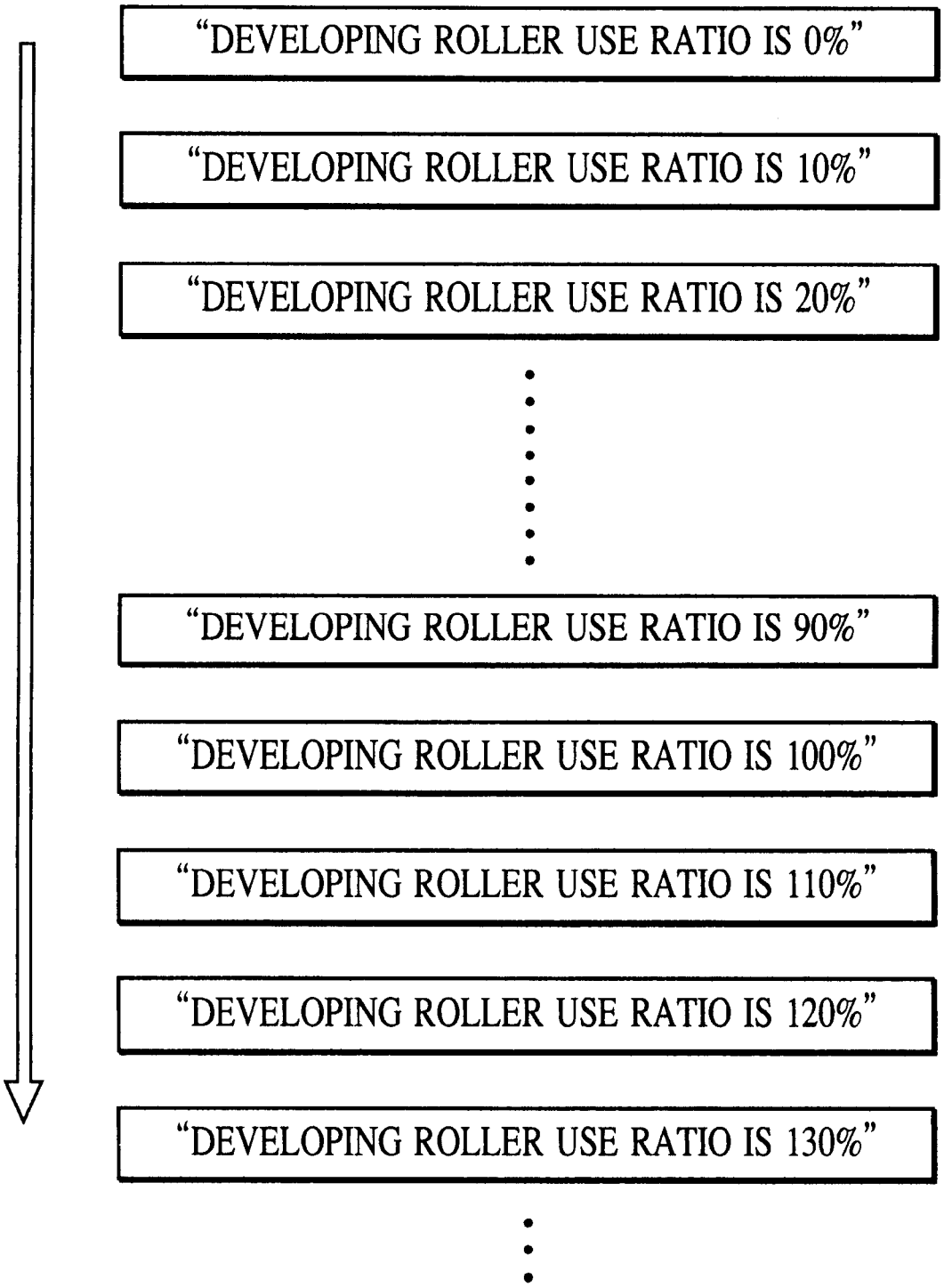
FIG. 10 is an explanatory diagram concerning an example of an indication of the use time of the developing roller in accordance with the present invention.

To be more specific, the use ratio of the developing roller 5*a* is comparable to the service life of the development unit C. For example, as shown in FIG. 10, a development unit use ratio may be adopted instead of the developing roller use ratio, and may then be indicated on the display devices 40 and 51. In this way, the development unit use ratio is incremented with the progress of use of the developing roller 5*a*, and thus reported to a user. That is to say, "The development unit use ratio is 0%." signifying that the use ratio of the development unit C is 0% is changed to "The development unit use ratio is 10%." signifying that the use ratio of the development unit C is 10%. "The development unit use ratio is 10%." is then changed to "The development unit use ratio is 20%." signifying that the use ratio of the development unit C is 20%. Even if the use ratio of the developing roller 5*a* exceeds a use ratio at which a manufacturer guarantees the performance of the developing roller, the use ratio of the developing roller is kept calculated. For example, a message "The development unit use ratio is 130%." signifying that the use ratio of the development unit C is 130% is displayed.

As mentioned above, the use time of the developing roller 5*a* indirectly related to the service life of the process cartridge B is indicated in the form of a use ratio that is incremented with the progress of use of the developing roller 5*a*. This helps prevent a user from getting confused at the information of the service life. The use times of consumables can be concisely provided for a user when needed. If a user complains to a manufacturer, the use situation of the developing roller 5*a* (development unit C) can be judged from the use time of the developing roller as a representative of the use situations of consumables other than a developer accommodated by the process cartridge B. For example, a serviceperson can give adequate advice to the user.

As mentioned above, according to the present embodiment, the amount of remaining developer that is a parameter used to directly manage the service life of the process cartridge B is indicated in the form of a remaining developer ratio that is decremented stepwise. The use times of the photosensitive drum 1 and developing roller 5*a* (development unit C) that are parameters indirectly related to the service life of the process cartridge B are indicated in the form of use ratios that are incremented stepwise..

Since the three parameters are adopted, the present embodiment can provide the same advantages as the first embodiment. In addition, the use time of the developing roller 5*a* is sensed and indicated as a criterion for the use situations of consumables accommodated by the process cartridge B other than the criterion of an amount of remaining developer. For example, if a user complains to a manufacturer about poor-quality images, the situation of the process cartridge B can be grasped properly and an adequate advice can be given to the user.

Furthermore, according to the present invention, even in the present embodiment, the use times of the other consumables may be adopted as parameters in addition to the amount of remaining developer. In this case, the timing of replacing the cartridge with a new one can be accurately reported to a user. Consequently, the user's convenience improves.

Third Embodiment

Next, another embodiment of the present invention will be described below. An image forming apparatus of the present embodiment has basically the same configuration as that of the second embodiment. The same reference numerals will be assigned to members having the same capabilities and structures. The description of the members will be omitted, but only a constituent feature of the present embodiment will be described below.

The constituent feature of the present embodiment lies in a method of indicating a sensed amount of remaining developer. According to the first embodiment, the sensed amount of remaining developer is indicated in the form of a remaining developer ratio in %. In the present embodiment, the indication form is changed to another during use of the process cartridge B.

According to the present embodiment, the amount of remaining developer is sensed regularly. The use times of the photosensitive drum 1 and developing roller 5*a* are sensed regularly as the use times of the other consumables. These three parameters are output mutually independently. According to the present embodiment, similarly to the first and second embodiments, the results of sensing are output to the main unit 100 and the host 50 that is a host computer or a terminal personal computer connected to the main unit in order to communicate with the main unit over a network. The results of sensing are then indicated on the display device 40 included in the main unit 100 and the display device 51 included in the host 50.

According to the present embodiment, the amount of remaining developer is adopted as a parameter used to directly manage the service life of the process cartridge B. The use times of the photosensitive drum 1 and developing roller 5*a* are adopted as parameters indirectly related to the service life of the process cartridge B. In case a user complains to a manufacturer, these three parameters are used as criteria for the use situations of consumables accommodated by the process cartridge B.

Talking of the forms for indicating the results of sensing, the use times of the photosensitive drum 1 and developing roller 5*a* indirectly related to management of the service life of the process cartridge B are indicated in the form of use ratios that are started with 0% and incremented with the progress of use. As for the sensed amount of remaining developer directly related to management of the service life of the process cartridge, it is indicated in the form of a remaining developer ratio that is decremented stepwise from 100% to 0%. According to the present embodiment, the form of a remaining developer ratio is changed to the form of the number of remaining sheets to be printed, that is, the number of printable sheets of paper in the course of using the developer.

The control sequence and principles for sensing the amount of remaining developer and the use times of the photosensitive drum 1 and developing roller 5*a* are identical to those employed in the first and second embodiments. The description of the control sequence and principles will be omitted. A method of indicating the sensed amount of remaining developer that is a constituent feature of the present embodiment will be described below.

Figure 11:
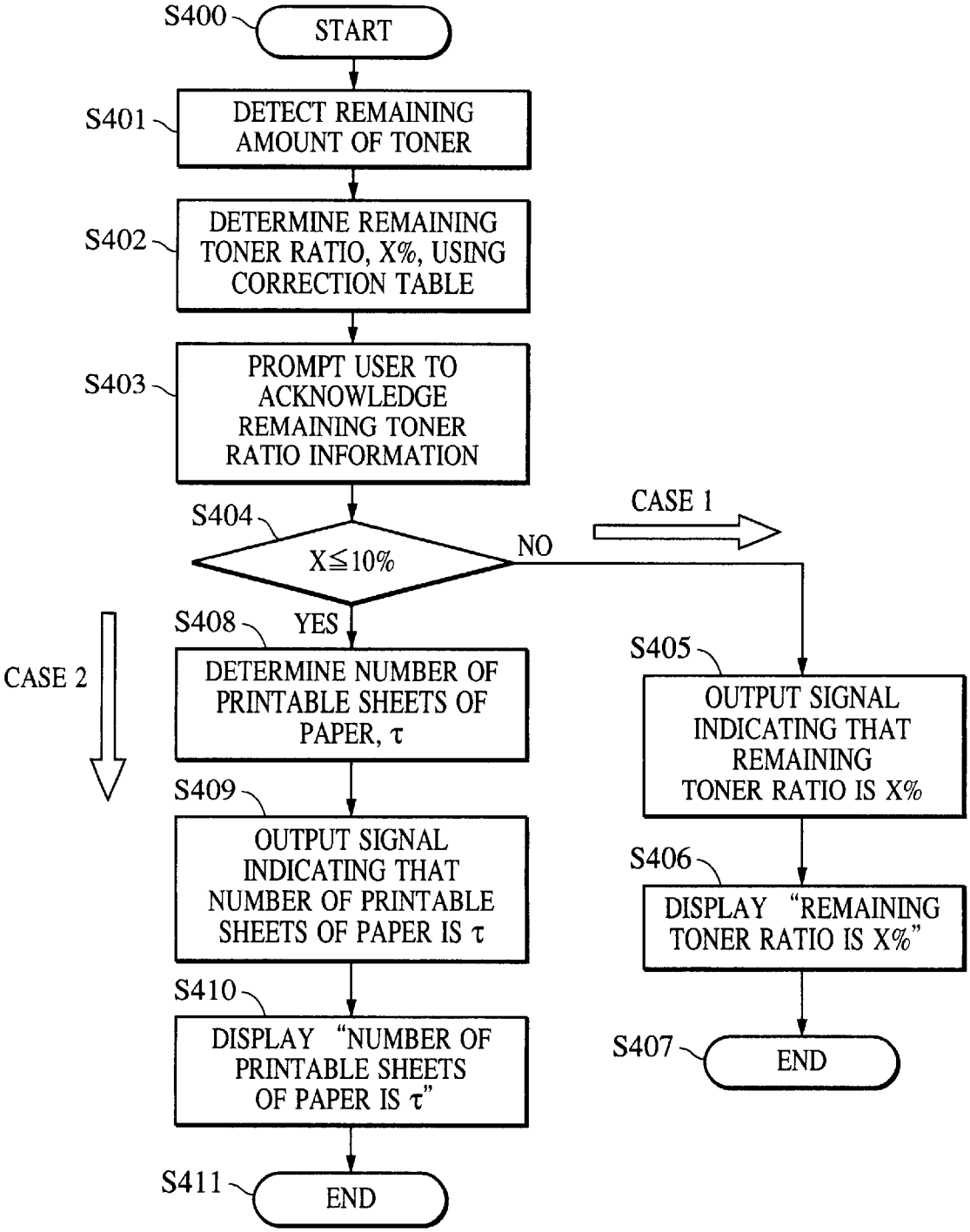
FIG. 11 is a flowchart describing another example of an action of indicating the amount of remaining developer in accordance with the present invention.

Referring to the flowchart of FIG. 11, a method of indicating an amount of remaining developer will be described below.

According to the present embodiment, when the amount of remaining developer is indicated in the form of a remaining developer ratio, once the remaining developer ratio becomes 10%, the form of a remaining developer ratio is changed to the form of the number of printable sheets of paper. According to the present embodiment, the remaining developer ratio of 10% is comparable to the number of printable sheets of paper of 500. The remaining developer ratios ranging from 10% to 0% are associated in advance with the numbers of printable sheets of paper. When the number of printable sheets becomes 0, a message "No toner. Change the cartridge." appears.

At step S400, a sequence is started.

At step S401, the control unit 22 calculates the amount of remaining developer.

At step S402, the control unit 22 determines X% as a remaining developer ratio using the correction table.

At step S403, a user acknowledges the remaining developer ratio indicated on the display device 40 of the main unit and the display device 51 of the host 50. Consequently, an acknowledge signal for acknowledging the remaining developer ratio is set to an on voltage level.

At step S404, the control unit judges whether X is equal to or smaller than 10%.

In case 1 where a judgment is made in the negative at step S404, the control unit 22 transmits a remaining developer ratio signal, which indicates that the remaining toner ratio is X%, to the display devices 40 and 51 at step S405.

At step S406, the display devices 40 and 51 display a message "The remaining toner ratio is X%."

At step S407, the sequence is terminated.

In case 2 where a judgment is made in the affirmative at step S404, the control unit 22 determines $\tau$ as the number of printable sheets of paper using the correction table listing remaining developer ratios in association with the numbers of printable sheets of paper at step S408.

At step S409, the control unit 22 transmits a remaining developer ratio signal, which indicates that the number of printable sheets of paper is $\tau$, to the display devices.

At step S410, the display devices 40 and 51 display a message "The number of printable sheets of paper is only $\tau$."

At step S411, the sequence is terminated.

Figure 12:
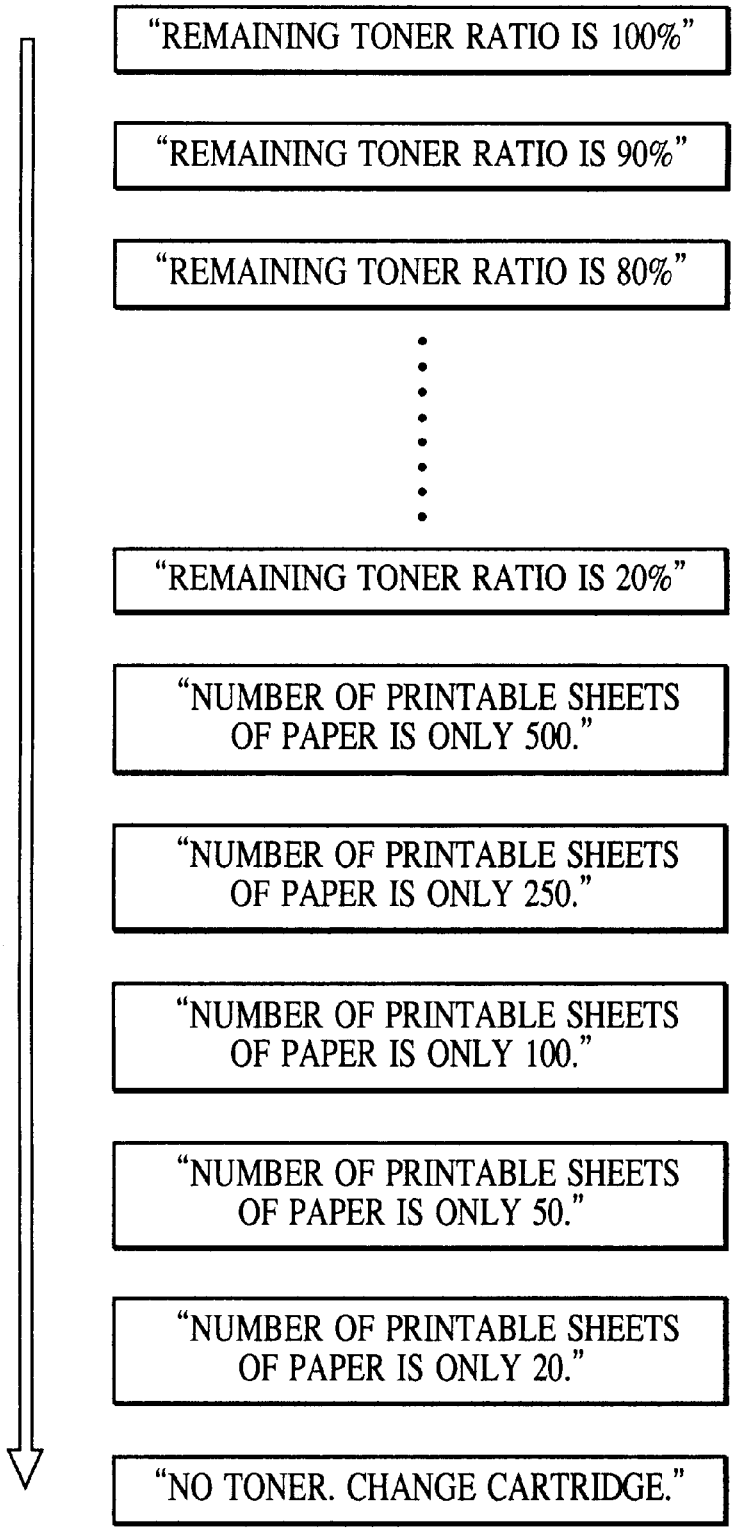
FIG. 12 is an explanatory diagram concerning another example of an indication of the amount of remaining developer in accordance with the present invention.

To be more specific, as shown in FIG. 12, when an amount of remaining developer is indicated on the display device 40 of the main unit and the display device 51 of the host 50, the amount of remaining developer is indicated in the form of a remaining developer ratio. The remaining developer ratio is decremented with the progress of use of the developer, and thus reported to a user. For example, the remaining toner ratio is 100%." signifying that the remaining developer ratio is 100% is changed to "The remaining toner ratio is 90%." signifying that the remaining developer ratio is 90%. "The remaining toner ratio is 90%." is then changed to "The remaining toner ratio is 80%." signifying that the remaining developer ratio is 80%. When the remaining developer ratio becomes 10%, the form of the remaining developer ratio is changed to the form of the number of printable sheets of paper in order to report the service life of the process cartridge B to the user in an easier-to-understand manner.

When the remaining developer ratio is 10%, "The number of printable sheets of paper is only 500.""appears. Thereafter, as the amount of remaining developer decreases, the number of printable sheets of paper is decremented stepwise. For example, "The number of printable sheets of paper is only 50." or "The number of printable sheets of paper is only 20." appears. When the remaining developer ratio becomes 0%, the message "No toner. Change the cartridge." is displayed in order to report a user the fact that the service life of the process cartridge B has completed its life span.

As mentioned above, according to the present embodiment, the amount of remaining developer that is a parameter used to directly manage the service life of the process cartridge B is indicated in the form of a remaining developer ratio that is decremented stepwise. When the amount of remaining developer becomes small, the indication form of a remaining developer ratio is changed to another form permitting a user to more easily recognize the service life of the process cartridge B. Moreover, the use times of the photosensitive drum 1 and developing roller 5*a* (development unit C) that are parameters indirectly related to the service life of the process cartridge B are indicated in the form of use ratios that are incremented stepwise.

Since the three parameters are adopted, the present embodiment can provide the same advantages as the first and second embodiments. In addition, when the amount of remaining developer becomes small, the form for indicating the amount of remaining developer that is used to directly manage the service life of the process cartridge B is changed to another. Consequently, the service life of the process cartridge B can be reported to a user in an easier to-understand manner.

According to the present invention, even in the present embodiment, not only an amount of remaining developer but also the use times of the other consumables are indicated. Consequently, the timing of replacing the cartridge with a new one can be accurately reported to a user. Eventually, the user's convenience improves.

Fourth Embodiment

Next, still another embodiment of the present invention will be described below. An image forming apparatus of the present embodiment has basically the same configuration as the one of the second embodiment. The same reference numerals will be assigned to members having the same capabilities and structures. The description of the members will be omitted, but only a constituent feature of the present embodiment will be described below.

The constituent feature of the present invention lies in a method of indicating a sensed amount of remaining developer. The amount of remaining developer is indicated not only in the form of a remaining developer ratio in %, which is employed in the first embodiment, but also in another form.

According to the present embodiment, the amount of remaining developer is sensed regularly. The use times of the photosensitive drum 1 and developing roller 5*a* are sensed regularly as the use times of the other consumables. These three parameters are output mutually independently. According to the present embodiment, similarly to the aforesaid embodiments, the results of sensing are output to the main unit 100 and the host 50 that is a host computer or a terminal personal computer connected to the main unit in order to communicate with the main unit over a network. The results of sensing, that is, the three parameters are then indicated on the display device 40 of the main unit and the display device 51 of the host 50.

According to the present embodiment, the amount of remaining developer is adopted as a parameter used to directly manage the service life of the process cartridge B. The use times of the photosensitive drum 1 and developing roller 5*a* are adopted as parameters indirectly related to the service life of the process cartridge B. In case a user complains to a manufacturer, the parameters are used as criteria for the use situations of the consumables included in the process cartridge B.

Talking of the form for indicating the results of sensing, the use times of the photosensitive drum 1 and developing roller 5*a*, which are indirectly related to management of the service life of the process cartridge, are indicated in the form of use ratios. The use ratios are started with 0% and incremented stepwise with the progress of use. As for a sensed amount of remaining developer directly related to management of the service life of the process cartridge, it is indicated in the form of the number of remaining sheets of paper to be printed, that is, the number of printable sheets of paper but not in the form of a remaining developer ratio. The number of printable sheets of paper is decremented stepwise with the progress of use of the developer.

A control sequence and principles for sensing an amount of remaining developer and the use times of the photosensitive drum 1 and developing roller 5*a* are identical to those employed in the first to third embodiments. The description of the control sequence and principles will therefore be omitted. A method of indicating a sensed amount of remaining developer that is a constituent feature of the present invention will be described below.

Figure 13:
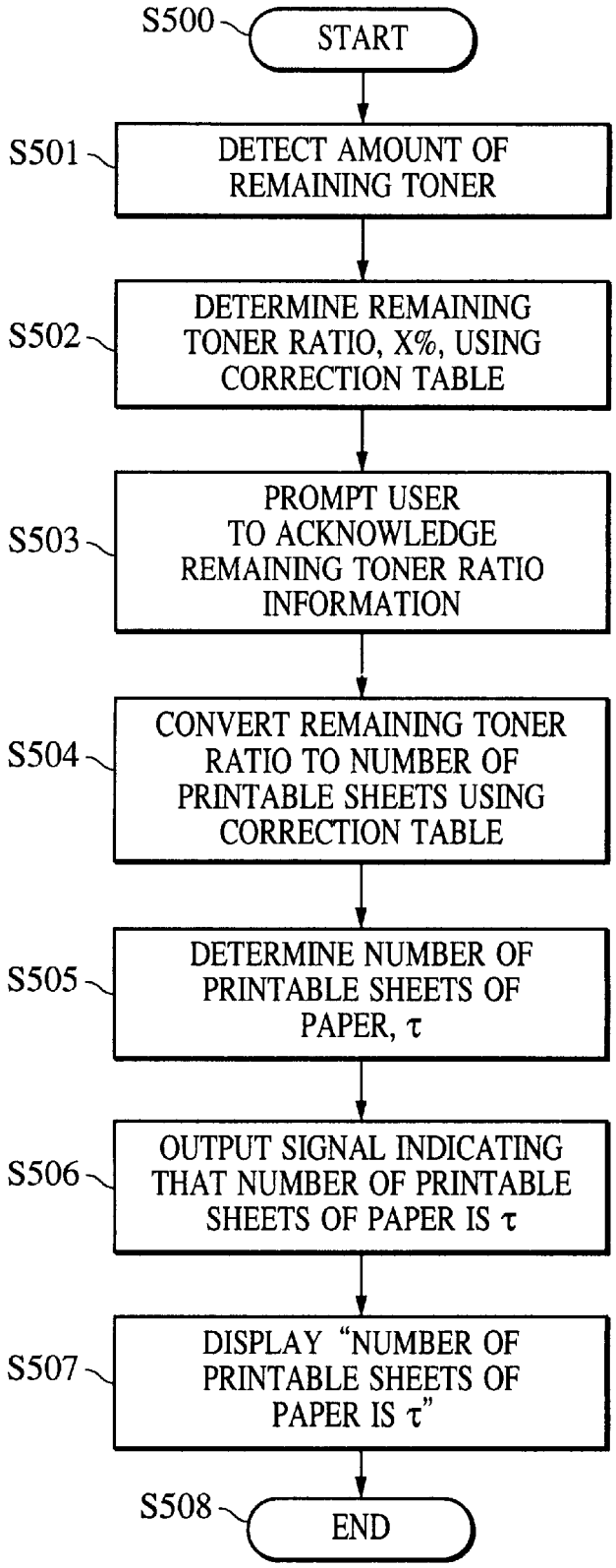
FIG. 13 is a flowchart describing another example of an action of indicating the amount of remaining developer in accordance with the present invention.

Referring to the flowchart of FIG. 13, a method of indicating an amount of remaining developer will be described below.

According to the present embodiment, the number of printable sheets of paper is calculated based on the amount of remaining developer and the user-dependent use situation of a developer per printout. When the number of printable sheets of paper becomes 0, the message "No toner. Change the cartridge." appears.

At step S500, a sequence is started.

At step S501, the control unit 22 calculates an amount of remaining developer.

At step S502, the control unit 22 determines X% as a remaining developer ratio using the correction table.

At step S503, a user acknowledges the remaining developer ratio indicated on the display device 40 of the main unit and the display device 51 of the host 50. Consequently, an acknowledge signal for acknowledging the remaining developer ratio is set to an on voltage level.

At step S504, the control unit 22 converts the remaining developer ratio into the number of printable sheets of paper using a correction table.

At step S505, the control unit 22 determines τ as the number of printable sheets of paper using the correction table listing remaining developer ratios in association with the numbers of printable sheets of paper.

At step S506, the control unit 22 transmits a remaining developer ratio signal, which indicates that the number of printable sheets of paper is 1, to the display devices 40 and 51.

At step S507, the display devices display a message "The number of printable sheets of paper is only τ."

At step S508, the sequence is terminated.

Figure 14:
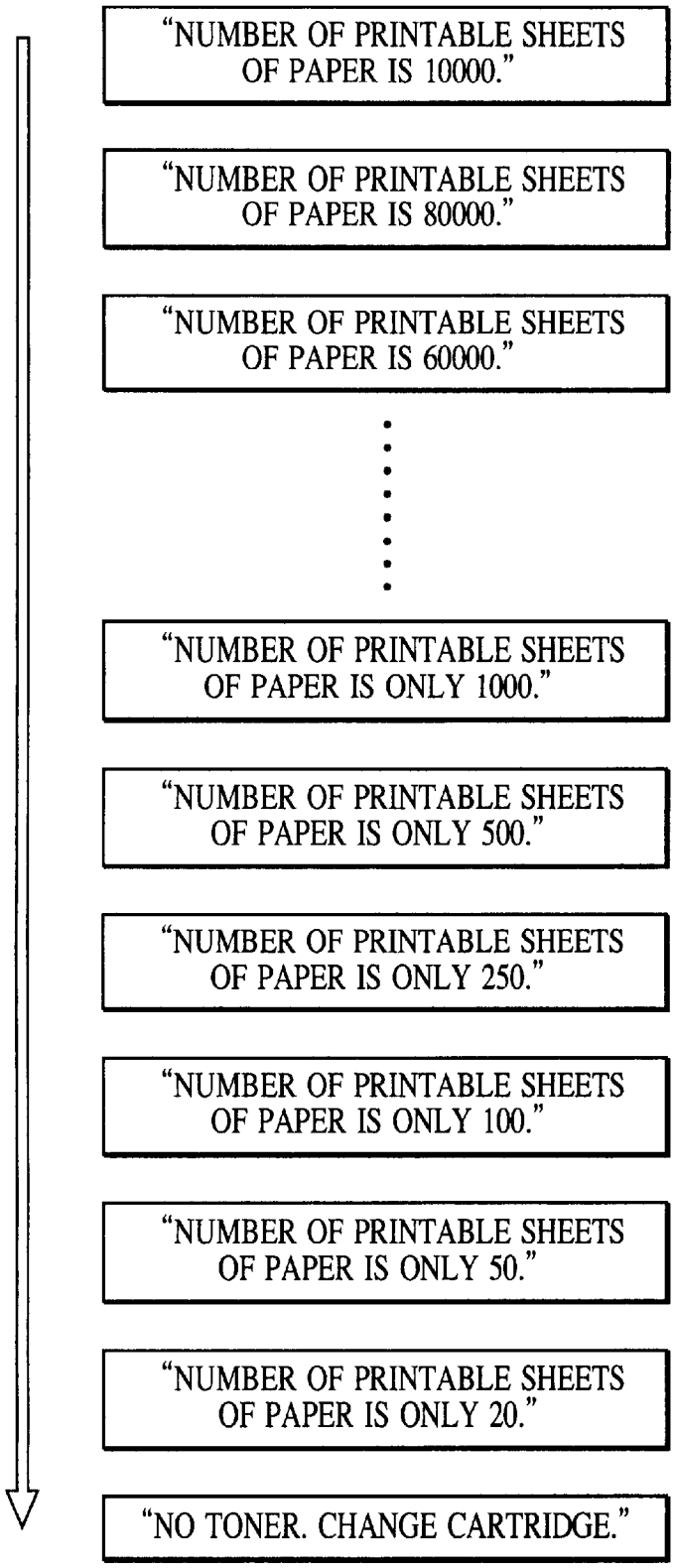
FIG. 14 is an explanatory diagram concerning another example of an indication of the amount of remaining developer in accordance with the present invention.

To be more specific, as shown in FIG. 14, when an amount of remaining developer is indicated on the display device 40 of the main unit and the display device 51 of the host 50, it is indicated in the form of the number of printable sheets of paper. The number of printable sheets of paper is decremented with the progress of use of a developer. For example, "The number of printable sheets of paper is 1000." for reporting a user the fact that numerous sheets of paper can be printed is changed to "The number of printable sheets of paper is 8000." and then to "The number of printable sheets of paper is 6000." Thereafter, as the amount of remaining developer decreases, "The number of printable sheets of paper is 100." is changed to "The number of printable sheets of paper is 50." When the number of printable sheets of paper becomes 0, the message "No toner. Change the cartridge." is displayed in order to report to a user in an easier-to-understand manner the fact that the service life of the process cartridge B has completed its life span.

As mentioned above, according to the present embodiment, the amount of remaining developer, that is a parameter used to directly manage the service life of the process cartridge B, is indicated in the form of the number of printable sheets of paper. The number of printable sheets of paper is decremented with a decrease in the amount of remaining developer. Moreover, the use times of the photosensitive drum 1 and developing roller 5*a* (development unit C) are adopted as parameters indirectly related to the service life of the process cartridge B and indicated in the form of use ratios that are incremented stepwise.

Since the three parameters are adopted, the present embodiment provides the same advantages as the first to third embodiment. In addition, the amount of remaining developer used to directly manage the service life of the process cartridge B can be indicated in a form permitting a user to more easily grasp the amount of remaining developer.

According to the present invention, not only an amount of remaining developer but also the use times of the other consumables are indicated. Consequently, the timing of replacing the cartridge with a new one can be reported accurately to a user. Eventually, the user's convenience improves.

Several embodiments of the present invention have been described so far.

According to the aforesaid embodiments, the amount of remaining developer and the use time of the photosensitive drum 1 or the amount of remaining developer and the use times of the photosensitive drum 1 and developing roller 5*a* (development unit C) are indicated on the display device 40 of the main unit 100 and the display device 51 of the host 50. At this time, characters are adopted as a means for indicating the amount of remaining developer and the use times. The present invention is not limited to this means. For example, the amount of remaining developer may be indicated in the form of a remaining developer ratio, that is, the ratio of the amount of remaining developer to an amount of developer filling a container (an amount of unused developer) by means of a graphic such as a gas gauge shown in FIG. 15 or a bar graph shown in FIG. 16.

Figure 15:
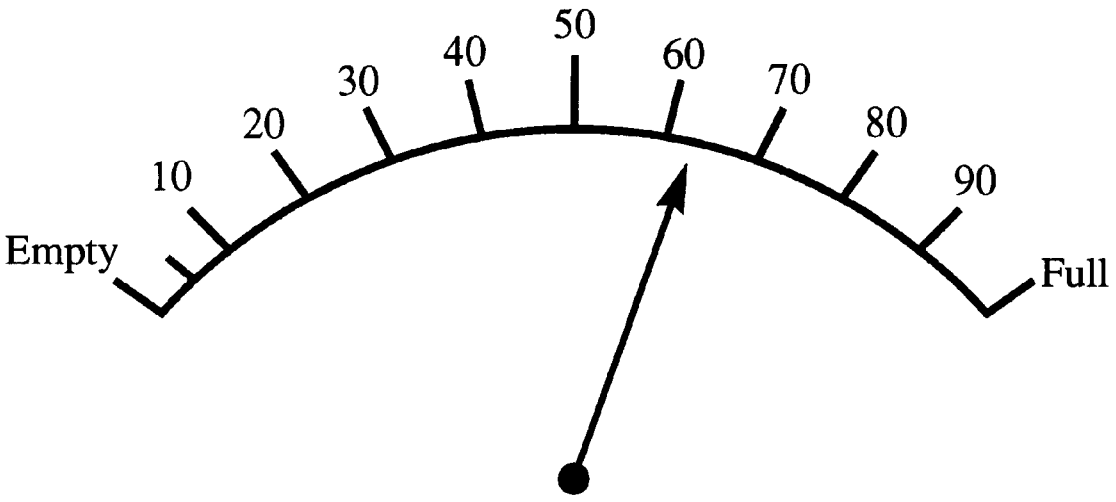
FIG. 15 shows another example of an indication of the amount of remaining developer in accordance with the present invention.
Figure 16:
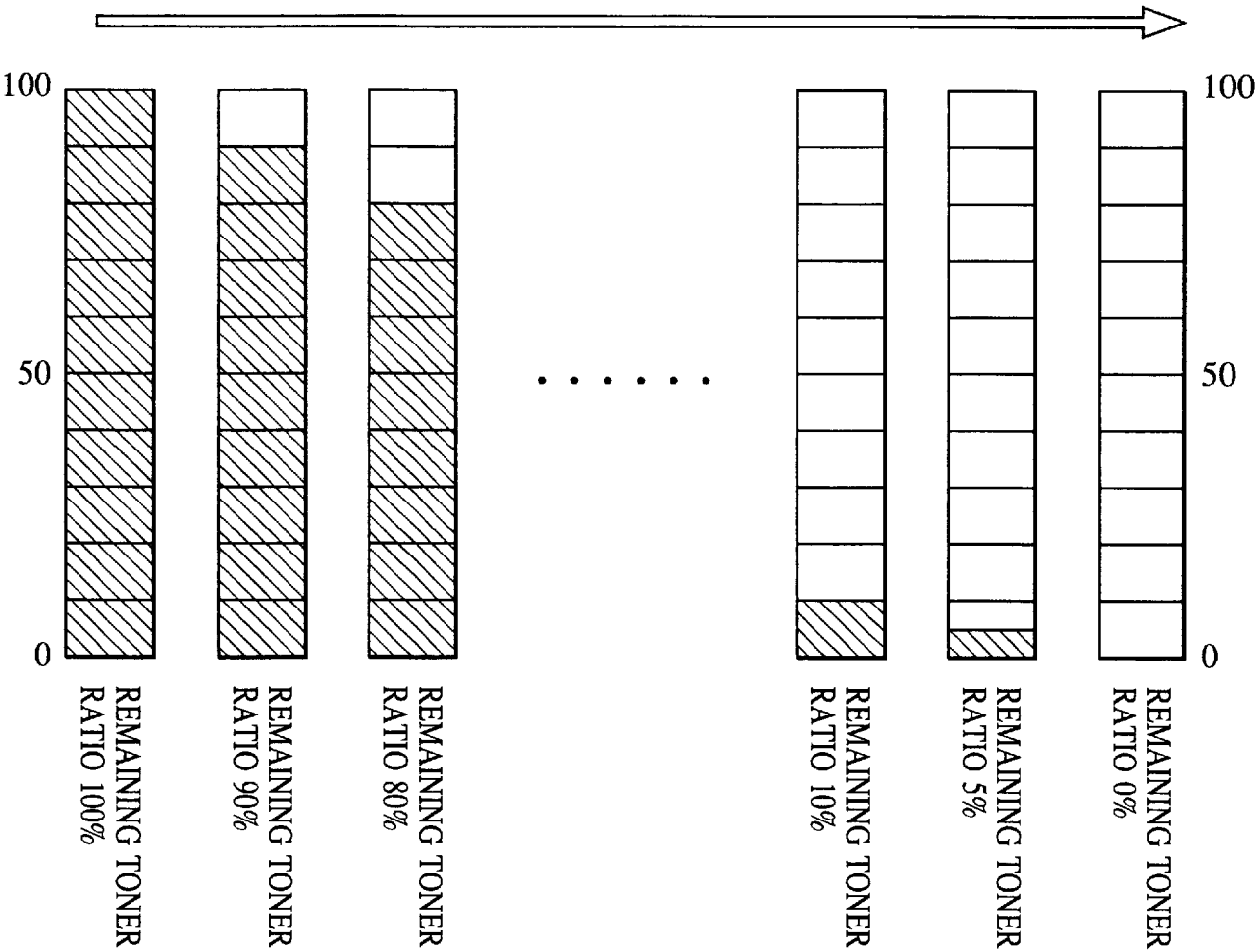
FIG. 16 shows another example of an indication of the amount of remaining developer in accordance with the present invention.

For example, the amount of remaining developer may be indicated using the graphic shown in FIG. 15 or FIG. 16. The use times of the other consumables (photosensitive drum, developing roller, and charging roller) may be indicated using characters. Thus, the amount of remaining developer and the use times of the other consumables may be indicated using different means. According to the present invention, the amount of remaining developer and the use times of the other consumables may be indicated using the same means or different means. Moreover, the amount of remaining developer adopted as a parameter used to directly manage the service life of the process cartridge B may be indicated at every time of image formation. In contrast, the use times of the photosensitive drum and developing roller adopted as parameters indirectly related to the service life of the process cartridge B may be indicated in response to a user's request.

Moreover, the means by which the amount of remaining developer and the use times of the other consumables are indicated are not limited to characters or a graphic. Any other means may be adopted as long as the means can communicate the information to a user. For example, a loudspeaker incorporated in a host that is a host computer or a terminal computer may be used to communicate the information to a user by means of voice. This makes it possible to concisely report the service life of a cartridge to various users. For example, when a remaining developer ratio is 0% (the number of printable sheets of paper is 0), a voice uttering "Toner has run out. Replace the cartridge with a new one." may be generated. Furthermore, the amount of remaining developer and the use times of the other consumables may be recorded on a recording material in response to a user's request.

In the aforesaid embodiments, a plate antenna type sensor is used as a remaining developer sensing means. The present invention is not limited to the remaining developer sensing means of the plate antenna type sensor. Any other sensor may be adopted as long as it can sense an amount of remaining developer. Moreover, according to the aforesaid methods, the use times of a photosensitive drum and a developing roller are sensed as parameters indirectly related to the service life of a cartridge. The use time of a charging roller may be substituted for the use times of the photosensitive drum and developing roller or may be sensed in addition to the use times thereof. For detecting the use time of the charging roller that is charging means, the application time of a charging bias may be measured, though what is measured is not limited to this one.

The present invention is not confined to the aforesaid embodiments, but includes variants constructed within the technological spirit of the invention.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A use situation reporting system for reporting use situations of a developer and other consumables included in an image forming apparatus for forming images on a recording material comprising:

amount-of-developer detecting means for detecting the amount of developer contained in a developer container;

sensing means for sensing the amount of use of said other consumables; and display means for indicating the amount of developer detected by said amount-of-developer detecting means and information related to the amount of use of said other consumables sensed by said sensing means, wherein an indication of the amount of developer to be displayed on said display means is decremented as the developer is used, and wherein information relating to the amount of use of said other consumables to be displayed on said display means are incremented as said other consumables are used.

2. A system according to claim 1, wherein a scale is used to indicate the amount of developer and a scale is used to indicate the amount of use of said other consumables, wherein the scale used to indicate the amount of developer starts with 100%, and the scale used to indicate the amount of use of said other consumables starts with 0%.

3. A system according to claim 1, wherein a form for indicating the amount of developer is the same as that for indicating information related to the amount of use of said other consumables.

4. A system according to claim 1, wherein a form for indicating the amount of developer is different from that for indicating information related to the amount of use of said other consumables.

5. A system according to claim 1, wherein the form for indicating the amount of developer is changed to another form during use of the developer.

6. A system according to claim 1, wherein the form for indicating the amount of developer is changed from the form of an amount of remaining developer to the form of a number of printable sheets of paper.

7. A system according to claim 1, wherein said display means is a display device included in a computer connected to the image forming apparatus.

8. A system according to claim 1, wherein said display means is a display device included in the image forming apparatus.

9. A system according to claim 1, wherein the amount of developer and information related to the amount of use of said other consumables are reported by means of voice.

10. A system according to claim 1, wherein the image forming apparatus has a cartridge, which accommodates the developer, detachably attached thereto, and said display means also indicates the service life of the cartridge.

11. A system according to claim 1, wherein the image forming apparatus comprises a photosensitive body, charging means for charging the photosensitive body, exposing means for exposing the charged photosensitive body in accordance with image information, developing means including a developer bearing member for bearing the developer, and developing a latent image, which is formed on the photosensitive body, using the developer, and transferring means for transferring the developed image onto the recording material, and said other consumables include at least one of the photosensitive body, the charging means, and the developer bearing member.

12. A system according to Claim 11, wherein the photosensitive body, the charging means, and the developing means are integrated into a cartridge, and the cartridge is detachably attached to a main assembly of the image forming apparatus.

13. A system according to claim 12, wherein the image forming apparatus further comprises a cleaning means for cleaning the photosensitive body, and the cleaning means is integrated into the cartridge.

14. An image forming apparatus for forming an image on a recording material in accordance with image information sent from an external image information output apparatus comprising:

a container for storing a developer;

remaining developer sensing means for sensing the amount of developer remaining in said container;

consumables other than the developer used to form developer images on the recording material;

amount-of-use sensing means for sensing the amount of use of said other consumables; and output means for outputting information of the amount of remaining developer sensed by said remaining developer sensing means and information related to the amount of use of said other consumables sensed by said amount-of-use sensing means to the external image information output apparatus.

15. An apparatus according to claim 14, further comprising:

a photosensitive body;

charging means for charging said photosensitive body;

exposing means for exposing said charged photosensitive body in accordance with the image information;

developing means including a developer bearing member for bearing the developer, and developing a latent image, which is formed on said photosensitive body, using the developer; and transferring means for transferring the developed image onto the recording material, wherein said consumables other than the developer include at least one of said photosensitive body, said charging means, and said developer bearing member.

16. An apparatus according to claim 15, wherein said photosensitive body, said charging means, said developing means, and said container are integrated into a cartridge that is detachably attached to a main assembly of said image forming apparatus.

17. An apparatus according to claim 16, further comprising cleaning means for cleaning said photosensitive body, wherein said cleaning means is integrated into said cartridge.

18. An apparatus according to claim 14, wherein the external image information output apparatus is a computer connected to said image forming apparatus.

19. An apparatus according to claim 14, further comprising display means for indicating the amount of remaining developer and the amount of use of said consumables other than the developer according to information output from said output means.

20. An apparatus according to claim 19, wherein an indication of the amount of remaining developer to be displayed on said display means is decremented with the progress of use of the developer, and information related to the amount of use of said consumables other than the developer are incremented with the progress of use of the other consumables other than the developer.

21. An apparatus according to claim 14, wherein said container is detachably attached to a main assembly of said image forming apparatus.

22. A use situation reporting system for reporting use situations of a developer and other consumables included in an image forming apparatus for forming images on a recording material according to image information sent from an image information output apparatus, said use situation reporting system comprising:

amount-of-developer detecting means for detecting the amount of developer contained in a developer container;

sensing means for sensing the amount of use of said other consumables; and display means for indicating the amount of developer detected by said amount-of- developer detecting means and information related to the amount of use of said other consumables sensed by said sensing means, wherein said display means is provided on the side of the image information output apparatus.

* * * * *

UNITED STATES PATENT AND TRADEMARK OFFICE

CERTIFICATE OF CORRECTION

PATENT NO. : 6,594,451 B2
DATED : July 15, 2003
INVENTOR(S) : Tomomi Kakeshita et al.

It is certified that error appears in the above-identified patent and that said Letters Patent is hereby corrected as shown below:

Column 3,
Line 60, “stowed” should read -- stored --.

Column 5,
Line 29, “stowed” should read -- stored --.

Column 8,
Line 1, “and a,” should read -- and a --.
Line 19, “stowed” should read -- stored --.

Column 12,
Line 25, “1he” should read -- the --.

Column 15,
Line 14, “stepwise..” should read -- stepwise. --.

Column 17,
Line 7, “the” should read -- The --.
Line 19, “500.”” ” should read -- 500.” --.
Line 26, “report” should read -- report to --.

Column 19,
Line 19, “reporting” should read -- reporting to --.

Column 21,
Lines 38 and 40, “the” should read -- said --.

Signed and Sealed this

Third Day of February, 2004

JON W. DUDAS
*Acting Director of the United States Patent and Trademark Office*